US005362610A

United States Patent [19]

Yoshimoto

[11] Patent Number: 5,362,610

[45] Date of Patent: Nov. 8, 1994

[54] PHOTOGRAPHIC PROCESSING AGENT

[75] Inventor: Hiroshi Yoshimoto, Hino, Japan

[73] Assignee: Konica Corporation, Tokyo, Japan

[21] Appl. No.: 197,540

[22] Filed: Feb. 17, 1994

Related U.S. Application Data

[63] Continuation of Ser. No. 958,648, Oct. 8, 1992, abandoned.

[30] Foreign Application Priority Data

Oct. 28, 1991 [JP] Japan ..... 3-281469

[51] Int. Cl.[5] ..... G03C 5/18; G03C 5/26

[52] U.S. Cl. ..... 430/465; 430/484; 430/485; 430/490; 430/493; 430/933

[58] Field of Search ..... 430/458, 461, 465, 467, 430/468, 483, 484, 485, 490, 493, 636, 933

[56] References Cited

U.S. PATENT DOCUMENTS

| | | | |
|---|---|---|---|
| 736,374 | 8/1903 | Fischer et al. | 430/484 |
| 2,193,015 | 3/1940 | Weissberger | 430/484 |
| 2,444,803 | 7/1948 | Bean | 430/465 |
| 2,482,546 | 9/1949 | Kaszuba . | |
| 2,596,926 | 5/1952 | Gunther et al. . | |
| 2,610,122 | 9/1952 | Hornchurch et al. . | |
| 2,618,558 | 11/1952 | Vittum et al. | 430/484 |
| 2,843,484 | 7/1958 | Baxendale . | |
| 3,128,182 | 4/1964 | Bard et al. . | |
| 3,128,183 | 4/1964 | Jones . | |
| 3,158,482 | 11/1964 | Lucas | 430/465 |
| 3,253,919 | 5/1966 | Beavers et al. . | |
| 3,260,718 | 7/1966 | Johnson . | |
| 3,287,124 | 11/1966 | Green . | |
| 3,287,125 | 11/1966 | Green . | |
| 3,335,161 | 8/1967 | Fields et al. . | |
| 3,532,501 | 10/1970 | Mackey et al. . | |
| 3,582,346 | 6/1971 | Dersch . | |
| 3,813,247 | 5/1974 | Minsk et al. . | |
| 3,963,499 | 6/1976 | Shiba et al. | 430/636 |
| 4,119,462 | 10/1978 | Hodes . | |
| 4,230,796 | 10/1980 | Gunther et al. . | |
| 4,301,236 | 11/1981 | Idota et al. | 430/461 |
| 4,414,307 | 11/1983 | Kapecki et al. | 430/484 |
| 4,565,776 | 1/1986 | Kim et al. | 430/490 |
| 4,797,349 | 1/1989 | Takahashi et al. | 430/467 |
| 4,956,267 | 9/1990 | Ueda et al. | 430/468 |
| 5,028,715 | 7/1991 | Kuse et al. | 430/467 |
| 5,063,140 | 11/1991 | Kuse et al. | 430/461 |
| 5,100,765 | 3/1992 | Fujimoto | 430/485 |
| 5,135,840 | 8/1992 | Reuter et al. | 430/965 |
| 5,217,854 | 6/1993 | Abe | 430/465 |
| 5,240,822 | 8/1993 | Tanaka et al. | 430/465 |

FOREIGN PATENT DOCUMENTS

| | | |
|---|---|---|
| 1125619 | 6/1982 | Canada . |
| 0087370 | 8/1983 | European Pat. Off. . |
| 0447655 | 9/1991 | European Pat. Off. . |

*Primary Examiner*—Charles L. Bowers, Jr.
*Assistant Examiner*—J. Pasterczyk
*Attorney, Agent, or Firm*—Frishauf, Holtz, Goodman & Woodward

[57] ABSTRACT

A solid photographic processing agent for a silver halide photographic light-sensitive material is disclosed. It has a bulk density of 0.5 to 6.0 g/cm$^3$, and comprises a photographic processing agent and at least one of the compounds represented by the following Formula (I):

Formula (I)

$$R-(O)_nSO_3X$$

wherein R represents an alkyl group having 1 to 8 carbon atoms, a phenyl group or a polymer chain having a repetition unit derived from an ethylenically unsaturated group; X represents a hydrogen atom, an alkali metal or an ammonium group; and n is an integer of 0 or 1.

5 Claims, No Drawings

PHOTOGRAPHIC PROCESSING AGENT

This application is a continuation of application Ser. No. 07/958,648, filed Oct. 8, 1992 (abandoned).

FIELD OF THE INVENTION

This invention relates to a photographic processing agent for silver halide photographic light sensitive material and particularly to a solid photographic processing agent for silver halide photographic light sensitive material improved in social environmental aptitude (for lowering pollution and saving natural resources), environmental hygiene at the workshop, the time-saving and practical simplification of the dissolving works, photographic processing characteristics (for preventing tar-out and stain production) and so forth.

BACKGROUND OF THE INVENTION

Silver halide photographic light sensitive materials are usually developed by making use of processing solutions such as a black-and-white developer, a fixer, a color developer, a bleacher, a bleach-fixer and a stabilizer, so that images can be obtained imagewise. Each of the processing solutions to be used therein is put into a plastic bottle in the form of a single part or plural parts of a concentrated solution so as to be supplied to users as a kit of processing agents. The users dissolve these processing agent kits in water so as to prepare a working solution (such as a starter solution or a replenisher solution).

In the photographic processing industry, there has been an increase in the so-called 'Mini-Labs' which are small-scale photofinishing laboratories wherein a small-sized automatic processor is used. With the advance of the above-mentioned laboratory miniaturization, the quantities of the plastic bottles for processing agents has rapidly increased year by year.

Plastics have also been widely used, in addition to the above-mentioned bottles for photographic processing agents, because they are light and strong in constitution. The output of plastics in the whole world is constantly increasing year by year and, in 1988, the yearly output thereof increased to exceed one hundred million tons. On the other hand, the amount of scrapped plastics has become huge. Taking the case of Japan, about 40% of the output is scrapped yearly. When the scrapped plastic is abandoned at sea, the living environment of oceanic life deteriorates. In Europe, problems such as acid rain occur because plastic is burned in incinerators having imperfect exhaust-gas treatment equipment.

It may be considered to make a concentrated solution of powdered photographic processing agents. When this is the case, however, the fine powder is whirled up in the air when dissolving the powder. There may be a high possibility that operators may inhale the fine powder and therefore concerns for the health of the operators may be raised. Or, the components of the processing agent may settle from the air into other processing solutions and therefore the problems of contaminating the solutions and producing difficulties may be raised. Therefore, the techniques for granulating photographic processing agents so as to make a granulated mixture thereof have been proposed in, for example, Japanese Patent Publication Open to Public Inspection (hereinafter referred to as JP OPI Publication) Nos. 2-109042/1990 and 2-109043/1990, U.S. Pat. No. 2,843,484 and JP OPI Publication No. 3-39735/1991. In the techniques, however, the following problems have still remained unsolved; namely, the problem of labor safety and hygiene raised by whirling up a powdered processing agent; contamination of the agent into other processing solutions; the so-called caking phenomenon including precipitation or coagulation at the bottom of a vessel when dissolving the agent; and preparation operability hindrance that its own wet layer covers the powder so as to produce a dissolution failure. It is, therefore, an actual situation that the scope of chemicals suitable for powdering or granulating have severely been limited.

For the desirable shapes of the processing agents having the advantages displayable in the dried state, JP OPI Publication No. 51-61837/1986 proposes a tablet type processing agent.

As for tar-out inhibitors for preventing a developing agent from producing any undesired tar-out into a developing bath when processing a development (the term, 'tar-out' means that a contaminant is deposited in the form of tar and the tar contaminates a processed material) and inhibitors for preventing from producing any undesired stain (that means stains on the white background of paper), the inhibitors having excellent characteristics including, for example, EG (ethylene glycol), DEG (diethylene glycol) and TEA (triethanol amine) have generally been recommended to use so far as a liquid type processing agent (or a developing agent). However, these tar-out inhibitors are not suitably put to practical use as a solid processing agent, because every one of them is in the liquid phase. Therefore, any characteristic deterioration cannot be prevented in the absence of these inhibitors, and the improvement thereof is one of the urgent requirements.

SUMMARY OF THE INVENTION

It is, therefore, an object of the invention to provide a solid processing agent for silver halide light sensitive material, in which the following improvements are made;

(1) A preservation aptitude for the social environment, including a drastic reduction of the disposal of used empty plastic containers; (2) An aptitude for a hygienic environment at work places, including powder flying prevention; (3) A time-saving and simplification of dissolution work, including the prevention of a caking phenomenon (which means that a dissolution failure occurs by a precipitation or coagulation at the bottom of a dissolution vessel) in the dissolution work, and the prevention of a self-core/shell phenomenon (which means that its own powder is covered by its own wet coated layer so as to produce a dissolution failure), by improving the solubility and, further, the increase in solubility of solid processing agents (including not only powdered or granulated agents, but also tablet type agents); (4) A prevention of the undesired tar-out of a developing agent into a developing bath when processing a development; and (5) A prevention or reduction of any undesired stain (stain at a white background of prints) produced in processing.

DETAILED DESCRIPTION OF THE INVENTION

The above-mentioned objects of the invention can be achieved with a solid photographic processing agent for a silver halide photographic light sensitive material, wherein at least one of the compounds represented by the following Formula (I) is contained.

Formula (I)

$R-(O)_nSO_3X$ wherein R represents an alkyl group having 1 to 8 carbon atoms or a phenyl group or a polymer chain having a repetition unit derived from an ethylenically unsaturated group; X represents a hydrogen atom, an alkali-metal atom or an ammonium group; and n is an integer of 0 or 1.

The compounds relating to the invention, which are represented by Formula (I) will be detailed below. In Formula (I), the substituted or non-substituted alkyl groups having 1 to 8 carbon atoms, which are represented by R, include, for example, a methyl, carboxymethyl, phenylmethyl, ethyl, hydroxyethyl, sulfonylethyl, propyl, butyl, tertiary butyl, cyclohexyl, heptyl, isooctyl or furanyl group. These alkyl groups may be straight-chained, branch-chained or in the cyclic form and they further include the groups each having a substituent. The substituents thereof include a halogen atom (such as a chlorine atom and a bromine atom), an aryl group (such as a phenyl group), a hydroxyl group, an amino group, a nitro group, a carboxylic acid group (including the salts thereof) and a sulfonic acid group (including the salts thereof). The phenyl group represented by R include those each having a substituent. The substituents thereof include a halogen atom (such as a chlorine atom and a bromine atom), an alkyl group (including, desirably, those each having 1 to 4 carbon atoms, such as a methyl group, an ethyl group, an isopropyl group and a butyl group), a hydroxyl group, an amino group, a nitro group, a carboxylic acid group (including the salts thereof) and a sulfonic acid group (including the salts thereof). The numbers of the substituents on the phenyl group may be one or 2 to 5. In the case where the phenyl group has 2 to 5 substituents, the substituents may be the same as or the different from each other.

Further, R may represent an ethylenic unsaturated group or may also represent a polymer having a repetition unit derived from the ethylenic unsaturated group.

R represents desirably a phenyl group and more desirably a phenyl group having a substituent. The desirable substituents include, for example, an alkyl group having 1 to 4 carbon atoms, a hydroxyl group, an amino group, a nitro group, a carboxylic acid group (including the salts thereof) and a sulfonic acid group (including the salts thereof).

X represents a hydrogen atom, an alkali-metal atom or an ammonium group. The alkali-metal atoms include a sodium atom, a potassium atom and a lithium atom. X represents desirably, a sodium atom, a potassium atom or an ammonium group, and n is preferably 0.

The typical examples of the sulfonic acid derivatives applicable to the invention, which are represented by the foregoing Formula (I), will be given below. However, this invention shall not be limited thereto.

Exemplified compounds (I-1)

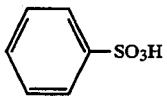

-continued (I-2)

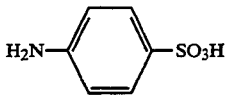

(I-3)

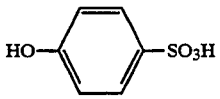

(I-4)

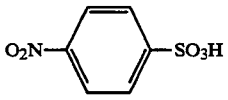

(I-5)

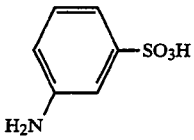

(I-6)

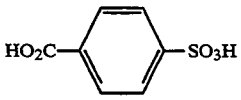

(I-7)

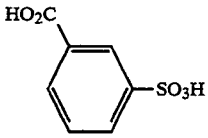

(I-8)

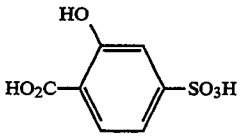

(I-9)

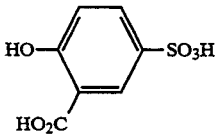

(I-10)

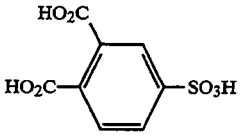

(I-11)

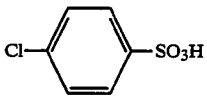

(I-12)

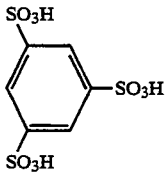

-continued
(I-13)
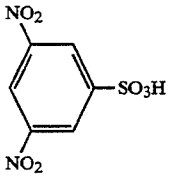
(I-14)
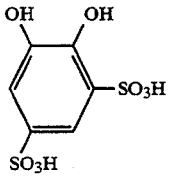
(I-15)
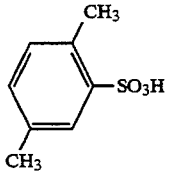
(I-16)
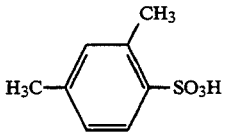
(I-17)
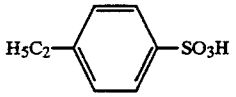
(I-18)
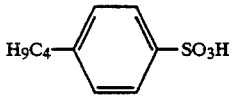
(I-19)
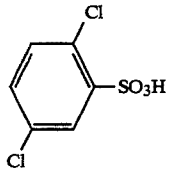
(I-20)
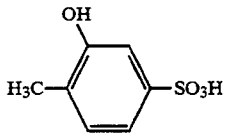
(I-21)
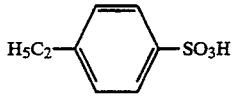
(I-22)
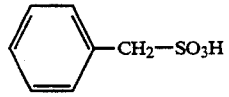
(I-23)
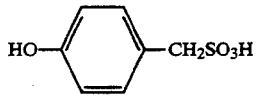
-continued
(I-24)
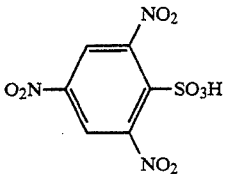
(I-25)
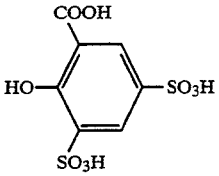
(I-26)
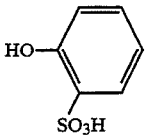
(I-27)
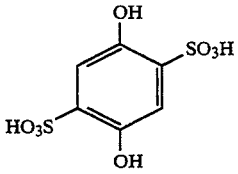
(I-28)
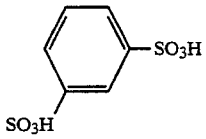
(I-29)
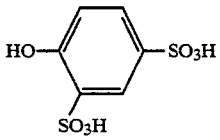
(I-30)
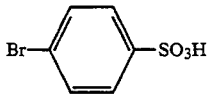
(I-31)
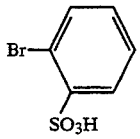
(I-32)
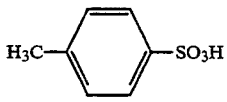
(I-33)
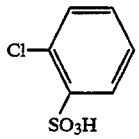
$H_3CSO_3H$ (I-34)
$H_2C(SO_3H)_2$ (I-35)
$C_6H_{13}SO_3H$ (I-36)
$C_7H_{15}SO_3H$ (I-37)

-continued $C_8H_{17}SO_3H$ (I-38)

$C_3H_7SO_3H$ (I-39)

$C_4H_9SO_3H$ (I-40)

$C_5H_{11}SO_3H$ (I-41)

$HO_3S—C_2H_4—SO_3H$ (I-42)

$HO—C_2H_4—SO_3H$ (I-43)

$HO_2CCH_2SO_3H$ (I-44)

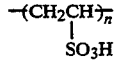
(I-45)

n = 3~300

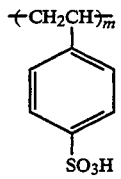
(I-46)

m = 3~300

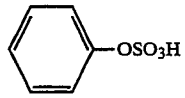
(I-47)

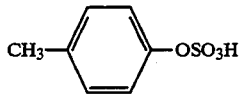
(I-48)

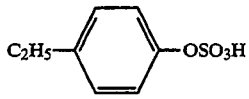
(I-49)

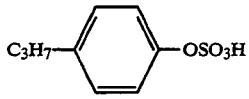
(I-50)

Among the above-given compounds, compounds I-17, I-18, I-38 and so forth are preferably used.

In the above-given exemplified compounds, it is a matter of course that each of the compounds having a sulfonic acid group or a carboxylic acid group includes the salts such as the sodium salts, potassium salts, lithium salts and ammonium salts of the respective compounds.

Some of the sulfonic acid derivatives of the invention are disclosed in British Patent Nos. 669,505 and 837,491 and JP OPI Publication Nos. 51-147322/1976 and 51-80229/1976, respectively. Those may be readily available to any person skilled in the art.

The sulfonic acid derivatives of the invention are used independently or in combination and they are used in an amount within the range of, 5.0 g to 100 g and preferably, 10 g to 80 g per liter of a color developing solution used.

They are more preferably used in an amount within the range of 20 g to 70 g. To be more concrete, in the invention, when the sulfonic acid derivatives represented by Formula (I) are used in an amount of not more than 5.0 g/liter, little effect may be displayed. When they are used in an amount of not less than 10 g and, desirably, not less than 20 g, the concentration of a color developing agent can be kept remarkably high in a processing solution such as a color developing replenisher and a color developer and oil-out can also be prevented, so that the characteristics of the processing solution can be stabilized. In particular, the effects of the invention can remarkably be displayed when making use of a color developing solution having a high chloride concentration. In addition to the above, the sulfonic acid derivatives serving as a dissolution accelerator can greatly increase, beyond the expectation, the solubility of a solid processing agent not only in the powdered or granulated forms, but also in the tablet form. Further, it is amazing indeed that the practically important dissolving step can be drastically shortened, simplified and stabilized.

A stain (such as a stain produced on the white background of paper prints) which can remain after completing the processing steps can further be reduced or improved.

The solid photographic processing agents of the invention may be used in the form of tablets, granules, powder, blocks or pastes and they may desirably be used in the form of tablets. The tablet processing agents may be prepared in any ordinary procedures such as those described in JP OPI Publication Nos. 3-141425/1991, 51-61837/1976, 54-155038/1979 and 52-88025/1977 and British Patent No. 1,213,808. The granulated processing agents may be prepared in any ordinary procedures such as those described in JP OPI Publication Nos. 2-109042/1990, 2-109043/1990, 3-39735/1991 and 3-39739/1991. Further, the powdered processing agents may be prepared in any ordinary procedures such as those described in JP OPI Publication No. 54-133332/1979; British Patent Nos. 725,892 and 729,862 and German Patent No. 3,733,861.

The bulk density of the solid photographic processing agents of the invention may be determined within the range of, preferably, 0.5 to 6.0 g/cm$^3$ and more preferably suitably, 1.0 to 5.0 g/cm$^3$, from the viewpoints of the solubility and the effects on the objects of the invention.

The amount of a processing agent and the compound represented by Formula (I) contained in solid photographic processing agent of the invention is so adjusted that the photographic processing solution can be prepared.

The solid photographic processing agents of the invention include a color developer, a black-and-white developer, a bleacher, a fixer, a bleach-fixer and a stabilizer. Among them, those capable of excellently displaying the effects of the invention are color developers.

In the invention, when the processing agent is a color developer, a color developing agent desirably applicable thereto is a p-phenylene diamine type compound having a water-solubilizing group, because it can excellently display the effects of the objects of the invention and can reduce fog production.

As compared to a paraphenylene diamine type compound not having any water-solubilizing group, such as N,N-diethyl-p-phenylene diamine, the p-phenylene diamine type compounds each having a water-solubilizing group not only have such an advantage that any light sensitive materials are not contaminated and any human skin is not poisoned even if it adheres to the skin, but also more effectively achieve the objects of the invention particularly when it is used in combination with the color developer of the invention.

The above-mentioned water-solubilizing groups include those among which at least one is on the amino group or benzene nucleus of a p-phenylene diamine type compound. The typical water-solubilizing groups include, desirably, $-(CH_2)_nCH_2OH$, $-(CH_2)_mNHSO_2(CH_2)_nCH_3$, $-(CH_2)_mO(CH_2)_nCH_3$, $-(CH_2CH_2O)_nC_mH_{2m+1}$ (in which m and n are each an integer of not less than 0), —COOH group and $-SO_3H$ group.

The typical exemplified compounds of the color developing agents desirably applicable to the invention include Compounds (C-1) through (C-16) given in JP OPI Publication No. 4-86741/1992, pp.26–31 and 4-amino-3-methyl-N-(3-hydroxy propyl)aniline.

The above-mentioned color developing agents are generally used in the form of salts such as a hydrochloride, a sulfate or a p-toluene sulfonate.

The color developing agents may be used independently or in combination. Further, if required, they may also be used together with a black-and-white developing agent such as Phenidone, 4-hydroxymethyl-4-methyl-1-phenyl-3-pyrazolidone and Metol.

The color developing agent content of the color developing solution is not less than $2.0\times10^{-2}$ mol/liter, and preferably $2.0\times10^{-2}$ to $1.0\times10^{-1}$ mol/liter.

In the invention and when a compound represented by the following Formulas (A) and (B) is contained in the color developing solution relating to the invention, not only the effects of the invention can further be displayed, but also the effect of reducing the fog produced in unexposed areas can be displayed. Therefore, this case is one of the desired embodiments of the invention.

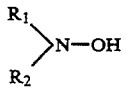

Formula (A)

wherein $R_1$ and $R_2$ represent each an alkyl group, an aryl group, an $R_3C(=O)$ group (wherein $R_3$ is defined below) or a hydrogen atom, provided that both of $R_1$ and $R_2$ shall not be hydrogen atoms at the same time or $R_1$ and $R_2$ may form a ring.

In the above-given Formula (A), the alkyl groups represented by $R_1$ and $R_2$ may be the same as or different from each other, however, they are desired to have 1 to 3 carbon atoms, respectively. Further, the alkyl groups are allowed to have a carboxyl group, a phosphoric acid group, a sulfo group or a hydroxyl group, respectively. $R_3$ represents an alkoxy group, an alkyl group or an aryl group. The alkyl groups and aryl groups represented by $R_1$, $R_2$ and $R_3$ include those having each a substituent. The rings allowed to be formed by $R_1$ and $R_2$ include a heterocyclic ring such as those of piperidine, pyridine, triazine or morpholine.

The compound (A) content of the color developing solution is 1 to 15 g/liter, and preferably 4 to 10 g/liter.

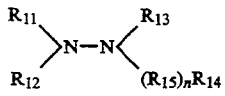

Formula (B)

wherein $R_{11}$, $R_{12}$ and $R_{13}$ represent each a hydrogen atom, a substituted or non-substituted alkyl, aryl or heterocyclic group; $R_{14}$ represents a hydroxyl group, a hydroxyamino group or a substituted or non-substituted alkyl, aryl, heterocyclic, alkoxy, aryloxy, carbamoyl or amino group. The heterocyclic groups have each a 5- or 6-membered ring. They are comprised of C, H, O, N, S or halogen atoms and may also be saturated or unsaturated; $R_{15}$ represents a divalent group selected from the group consisting of —CO—, $-SO_2-$ or —C(=NH)—; and n is an integer of 0 or 1, provided that, when n=0, $R_{14}$ represents a group selected from the group consisting of alkyl groups, aryl groups and heterocyclic groups and that $R_{13}$ and $R_{14}$ may also be associated to form a heterocyclic ring.

The typical examples of the hydroxyl amine type compounds represented by the foregoing Formula (A) are given in U.S. Pat. Nos. 3,287,125, 3,329,034 and 3,287,124. The particularly desirable exemplified compounds include Compounds (A-1) through (A-39) given in JP Publication No. 4-86741/1992, pp. 36–38, Compounds (1) through (53) given in JP OPI Publication No. 3-33845/1991, pp.3–6 and Compounds (1) through (52) given in JP OPI Publication No. 3-63646/1991, pp.5–7.

Next, the typical examples of the compounds represented by the foregoing Formula (B) include Compounds (B-1) through (B-33) given in JP Application No. 2-203169/1990, pp.40–43 and Compounds (1) through (56) given in JP OPI Publication No. 3-33846/1991, pp.4–6.

The compound (B) content of the color developing solution is 1 to 15 g/liter, and preferably 4 to 10 g/liter.

The compounds represented by Formula (A) or (B) are generally used in the form of a free amine, a hydrochloride, a sulfate, a p-toluene sulfonate, an oxalate, a phosphate or an acetate.

The hydroxyl amine type compounds represented by the following Formula (A') may also desirably be used as the preservatives for color developers.

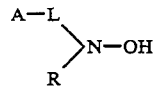

Formula (A')

wherein L represents a substitutable alkylene group; A represents a carboxyl group, a sulfo group, a phosphono group, a phosphino group, a hydroxyl group or an alkyl-substitutable amino, amido, carbamoyl or sulfamoyl group; and R represents a hydrogen atom or a substitutable alkyl group.

The typical examples of the compounds represented by Formula (A') include Compounds (1) through (54) given in JP OPI Publication No. 3-184044/1991, the lower left column of p.4 to the lower right column of p.6. Among these examples, the compounds represented by the following structures (1) and (7) are desirable.

$$HON(CH_2CH_2COOH)_2 \quad (1)$$

$$HON(CH_2CH_2SO_3H)_2 \quad (7)$$

The compounds represented by Formula (A') may be prepared by making an alkylation reaction of a hydroxyl amine available on the market. For example, they may be synthesized in the synthesizing procedures detailed in West German Patent No. 1,159,634 or Inorganica Chimica Acta, 93 (1984), pp.101–108.

The compound (A') content of the color developing solution is 1 to 15 g/liter, and preferably 4 to 10 g/liter.

In the color developers and black-and-white developers each relating to the invention, a small amount of a sulfite may be used for a preservative. Such a sulfite includes, for example, sodium sulfite, potassium sulfite, sodium bisulfite and potassium bisulfite.

In the color developers and black-and-white developers each relating to the invention, a buffer is to be used. The buffers include, for example, sodium carbonate, potassium carbonate, potassium bicarbonate, trisodium phosphate, tripotassium phosphate, disodium phosphate, dipotassium phosphate, sodium borate, potassium borate, sodium tetraborate (or boric acid), potassium tetraborate, sodium o-hydroxybenzoate (or sodium salicylate), potassium o-hydroxybenzoate, sodium 5-sulfo-2-hydroxybenzoate (or sodium 5-salicylate) and potassium 5-sulfo-2-hydroxybenzoate (or potassium 5-sulfosalicylate).

The development accelerators include, for example; thioether type compounds typified by those given in JP Examined Publication Nos. 37-16088/1962, 37-5987/1962, 38-7826/1963, 44-12380/1969 and 45-9019/1970 and U.S. Pat. No. 3,813,247; p-phenylene diamine type compounds typified by those given in JP OPI Publication Nos. 52-49829/1977 and 50-15554/1975; quaternary ammonium salts typified by those given in JP Examined Publication No. 44-30074/1969 and JP OPI Publication Nos. 50-137726/1975, 56-156826/1981 and 52-43429/1977; p-aminophenols given in U.S. Pat. Nos. 2,610,122 and 4,119,462; amine type compounds given in U. S. Pat. Nos. 2,494,903, 3,128,182, 4,230,796 and 3,253,919, JP Examined Publication No. 41-11431/1966 and U.S. Pat. Nos. 2,482,546, 2,596,926 and 3,582,346; polyalkylene oxides typified by those given in JP Examined Publication Nos. 37-16088/1962 and 42-25201/1967, U.S. Pat. No. 3,128,183, JP Examined Publication Nos. 41-11431/1966 and 42-23883/1967 and U.S. Pat. No. 3,532,501; and, besides the above, a 1-phenyl-3-pyrazolidone, a hydrazine, a mesoionic type compound, an ionic type compound and an imidazole. They may be so added as to meet the requirements.

For the purposes of preventing a fog production and so forth, chlorine ion and bromine ion may also be applied to a color developer. In the invention, chlorine ions are contained in a proportion within the range of, desirably, $1.0\times10^{-2}$ to $1.5\times10^{-1}$ mols/liter and, more desirably, $3.5\times10^{-2}$ to $1\times10^{-1}$ mols/liter of a color developer used. When a chlorine ion concentration is more than $1.5\times10^{-1}$ mols/liter, a development is retarded and it is therefore not suitable to rapidly obtain a high maximum density. When it is less than $3.5\times10^{-2}$ mols/liter, a stain is produced and it is therefore not suitable, because the serious variations of the photographic characteristics (including particularly the minimum density) are derived from a series of continuous processing treatments.

In the invention, a color developer contains bromine ions in a proportion within the range of, desirably, $3.0\times10^{-5}$ to $1.0\times10^{-3}$ mols/liter, more desirably, $5.0\times10^{-5}$ to $5\times10^{-4}$ mols/liter and, particularly, $1\times10^{-4}$ to $3\times10^{-4}$ mols/liter. When a bromine ion concentration is more than $1\times10^{-3}$ mols/liter, a development is retarded and both of a maximum density and a sensitivity are lowered. When it is less than $3.0\times10^{-5}$ mols/liter, a stain is produced and it is therefore not suitable, because the serious variations of the photographic characteristics (including particularly the minimum density) are derived from a series of continuous processing treatments.

When these ions are added directly into a color developer, the chlorine ion supplying materials may include sodium chloride, potassium chloride, ammonium chloride, nickel chloride, magnesium chloride, manganese chloride, calcium chloride and cadmium chloride. Among these materials, sodium chloride and potassium chloride may be preferred.

They may also be supplied in the form of the counter salts of a fluorescent whitening agent which is to be added into a color developer and a developer.

The bromine ion supplying materials include sodium bromide, potassium bromide, ammonium bromide, lithium bromide, calcium bromide, magnesium bromide, manganese bromide, nickel bromide, cadmium bromide, cerium bromide and thallium bromide. Among these materials, potassium bromide and sodium bromide may be preferred.

If required, the color developers and developers of the invention are each allowed to be further added with any desired antifoggant, besides the above-given chlorine ions and bromine ions. The antifoggants applicable thereto include an alkali-metal halide such as potassium iodide and an organic antifoggant. The organic antifoggants may be typified by nitrogen-containing heterocyclic compounds including, for example, benzotriazole, 6-nitrobenzoimidazole, 5-nitroisoindazole, 5-methylbenzotriazole, 5-nitrobenzotriazole, 5-chlorobenzotriazole, 2-thiazolylbenzo imidazole, 2-thiazolylmethylbenzoimidazole, indazole, hydroxyazaindolidine and adenine.

From the viewpoint of displaying the effects of the objects of the invention, it is desired to add a triazinyl stilbene type fluorescent whitening agent in the color developers and developers each of the invention. The fluorescent whitening agents include, desirably, the compounds represented by the following Formula (E).

Formula (E)

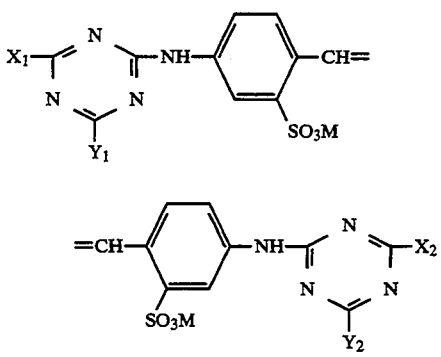

wherein $X_1$, $X_2$, $Y_1$ and $Y_2$ represent each a hydroxyl group, a halogen atom such as a chlorine atom or bromine atom, an alkyl group, an aryl group, a $-N(R_{21})(R_{22})$ group,

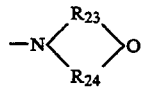

or $OR_{25}$, in which $R_{21}$ and $R_{22}$ represent each a hydrogen atom, an alkyl group (including those substituted) or an aryl group (including those substituted); $R_{23}$ and $R_{24}$ represent each an alkylene group (including those substituted); $R_{25}$ represents a hydrogen atom, an alkyl group (including those substituted) or an aryl group (including those substituted); and M represents a cation.

The details of the groups represented by Formula (E) and the substituents thereof are synonymous with those described in JP OPI Publication No. 4-118649/1992, the 8th line from the bottom of p. 62 to the 3rd line from the bottom of p. 64. The typical compounds thereof may include Compounds E-1 through E-45 given in the same Patent Application, pp.65–67.

The above-mentioned compounds can be synthesized in any known procedures. The typical compounds will be exemplified below. Among them, those desirably applicable thereto include, particularly, E-4, E-24, E-34, E-35, E-36, E-37 and E-41. These compounds may be added in an amount within the range of, desirably, 0.2 to 10 g per 1000 ml of a color developer used and, more desirably, 0.4 to 5 g.

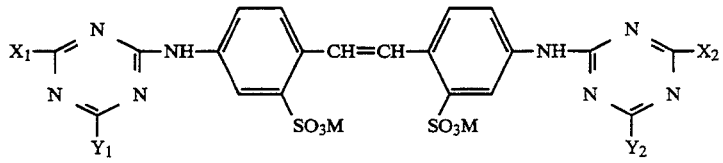

| Compound No. | M | $X_1$ | $Y_1$ | $Y_2$ | $X_2$ |
|---|---|---|---|---|---|
| E-2 | Na | $HOCH_2CH_2NH-$ | $-NHCH_2CH_2OH$ | $-NHCH_2CH_2OH$ | $-NHCH_2CH_2OH$ |
| E-4 | Na | $(HOCH_2CH_2)_2N-$ | $-OCH_3$ | $-OCH_3$ | $-N(CH_2CH_2OH)_2$ |
| E-7 | Na | 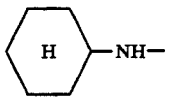 | $-NHCH_2CH_2OH$ | $-NHCH_2CH_2OH$ | 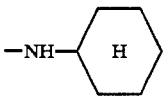 |
| E-10 | Na | $H_2N-$ | 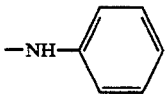 | 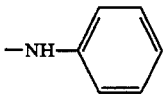 | $-NH_2$ |
| E-17 | Na | 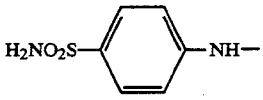 | $-N(CH_2CH_2OH)_2$ | $-N(CH_2CH_2OH)_2$ | 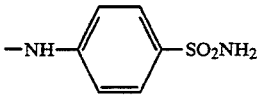 |
| E-24 | Na | 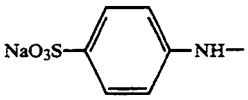 | 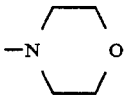 | 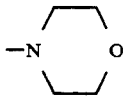 | 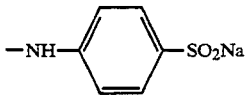 |
| E-34 | Na | $CH_3O-$ | $-NHCH_2CHCH_3$ (OH) | $-NHCH_2CHCH_3$ (OH) | $-OCH_3$ |
| E-35 | Na | 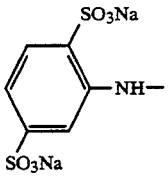 | 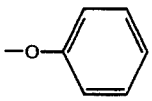 | 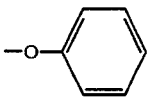 | 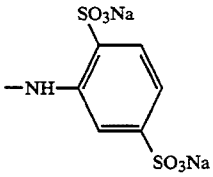 |
| E-36 | Na | 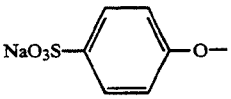 | $-N(CH_2CH_2OH)_2$ | $-N(CH_2CH_2OH)_2$ | 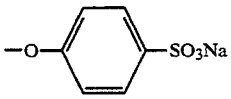 |
| E-37 | Na | 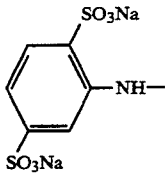 | $-N(C_2H_5)_2$ | $-N(C_2H_5)_2$ | 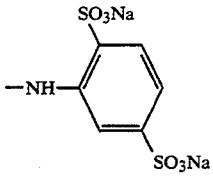 |
| E-40 | Na | $CH_3O-$ | $-N(CH_2CH_2OH)_2$ | $-N(CH_2CH_2OH)_2$ | $-OCH_3$ |
| E-41 | Na | $CH_3O-$ | $-NHCH_2CH_2SO_3Na$ | $-NHCH_2CH_2SO_3Na$ | $-OCH_3$ |
| E-42 | Na | $CH_3O-$ | $-NHCH_2CH_2OH$ | $-NHCH_2CH_2OH$ | $-OCH_3$ |

-continued

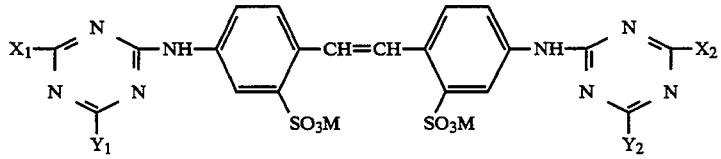

| Compound No. | M | $X_1$ | $Y_1$ | $Y_2$ | $X_2$ |
|---|---|---|---|---|---|
| E-43 | Na | $CH_3O-$ | 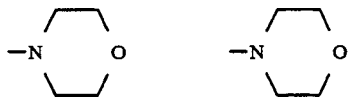 |  | $-OCH_3$ |
| E-44 | Na | $CH_3O-$ | $-NHCH_2CH_2SO_3K$ | $-N(CH_2CH_2OH)_2$ | $-OCH_3$ |

If required, the color developers and black-and-white developers each applicable to the invention are further allowed to make combination use with methyl cellosolve, methanol, acetone, dimethyl formamide, β-cyclodextrin and, besides, the compounds given in JP Examined Publication Nos. 47-33378/1972 and 44-9509/1969 so as to serve as an organic solvent for increasing the solubility of a developing agent used.

Further, an auxiliary developer may also be used together with a developing agent. The known auxiliary developers include, for example, N-methyl-p-aminophenol hexasulfate (or Metol), Phenidone, N,N-diethyl-p-aminophenol hydrochloride and N,N,N',N'-tetramethyl-p-phenylene diamine hydrochloride. They may usually be added in an amount within the range of, desirably, 0.01 to 1.0 g/liter.

Still further, a variety of additives such as an antistaining agent, an antisludging agent and an interlayer-effect accelerator may be used therein, besides the above.

From the viewpoint of effectively achieving the objects of the invention, the color developers and black-and-white developers are each desired to contain the chelating agent represented by the following Formula (K) given in JP Publication No. 4-118649/1992, the 9th line from the bottom of p.69 to p.74 and the exemplified compounds K-1 through K-22 given therein.

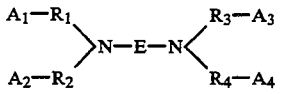

Formula (K)

Among the above-mentioned chelating agents, K-2, K-9, K-12, K-13, K-17 and K-19 may desirably be used and, in particular, when K-2 and K-9 are added into a color developer, the effects of the invention can be displayed more excellently.

These chelating agents may be added in an amount within the range of, desirably, 0.1 to 20 g per 1000 ml of a color developer or a black-and-white developer and, more desirably, 0.2 to 8 g.

Further, the color developers and black-and-white developers are also allowed to contain each of anionic, cationic, amphoteric or nonionic surfactants. If required, it is further allowed to add various kinds of surfactants such as alkyl sulfonic acid, aryl sulfonic acid, aliphatic carboxylic acid and aromatic carboxylic acid. When a processing agent relating to the invention is a bleacher or a bleach-fixer, a bleaching agent of the bleacher is a ferric complex salt of an organic acid represented by the following Formula (L).

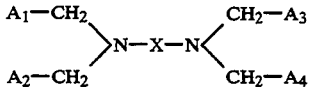

Formula (L)

wherein $A_1$ through $A_4$ may be the same with or the different from each other and represent each $-CH_2OH$, —COOM or $-PO_3M_1M_2$; M, $M_1$ and $M_2$ represent each a hydrogen atom, an alkali-metal atom or an ammonium group; and X represents a substituted or unsubstituted alkylene group having 3 to 6 carbon atoms.

The compounds represented by Formula (L) will now be detailed below.

The detailed description of the groups represented by $A_1$ through $A_4$ will be omitted, because they are synonymous with $A_1$ through $A_4$ described in JP Publication No. 2-191952/1990, the 15th line of p.12 to the 3rd line of p.15.

The typical examples of the desirable compounds represented by the foregoing Formula (L) will be given below.

(L-1) 1,3-propanediamine tetraacetic acid,
(L-2) 2-hydroxy-1,3-propanediamine tetraacetic acid,
(L-3) 2,3-propanediamine tetraacetic acid,
(L-4) 1,4-butanediamine tetraacetic acid,
(L-5) 2-methyl-1,3-propanediamine tetraacetic acid,
(L-6) N-(2-hydroxyethyl) -1,3-propanediamine tetraacetic acid,
(L-7) 1,3-propanediamine tetrakismethylene phosphonic acid,
(L-8) 2-hydroxy-1,3-propanediamine tetrakismethylene phosphonic acid,
(L-9) 2,2-dimethyl-1,3-propanediamine tetraacetic acid,
(L-10) 2,4-butanediamine tetraacetic acid,
(L-11) 2,4-pentanediamine tetraacetic acid, and
(L-12) 2-methyl-2,4-pentanediamine tetraacetic acid As for the ferric complex salts of the above-given compounds (L-1) through (L-12) , the sodium salts, potassium salts or ammonium salts of these ferric complexes may arbitrarily be used. Among them, the ammonium salts thereof are desirably used from the viewpoints of the effects of the objects of the invention and the solubility. Among the above-given examples of the compounds, those particularly desirable for the invention include (L-1), (L-3), (L-4), (L-5) and (L-9) and, inter alia, (L-1) is particularly more desirable. In the invention, a bleacher or a bleach-fixer may be applied with the ferric complexes of the following compounds as well as the iron complexes of the compounds represented by the foregoing Formula (L).

(L'-1) Ethylenediamine tetraacetic acid,
(L'-2) Trans-1,2-cyclohexanediamine tetraacetic acid,
(L'-3) Dihydroxyethyl glycinic acid,
(L'-4) Ethylenediamine tetrakismethylene phosphonic acid,
(L'-5) Nitrilotrismethylene phosphonic acid,
(L'-6) Diethylenetriamine pentakismethylene phosphonic acid,
(L'-7) Diethylenetrlamine pentaacetic acid,
(L'-8) Ethylenediamine diorthohydroxyphenyl acetic acid,
(L'-9) Hydroxyethyl ethylenediamine triacetic acid,
(L'-10) Ethylenediamine dipropionic acid,
(L'-11) Ethylenediamine diacetic acid,
(L'-12) Hydroxyethyliminodiacetic acid,
(L'-13) Nitrilotriacetic acid,
(L'-14) Nitrilotripropionic acid,
(L'-15) Triethylenetetramine hexaacetic acid, and
(L'-16) Ethylenediamine tetrapropionic acid The above-given ferric complexes of organic acids may be added in a proportion within the range of, desirably, 0.1 to 2.0 mols per 1000 ml of a bleacher or a bleach-fixer used and, more desirably, 0.15 to 1.5 mols/-liter thereof.

When a bleacher, a bleach-fixer or a fixer contains the imidazole and the derivatives each described in JP OPI Publication No. 64-295258/1989 or the compounds represented by Formulas (I) through (IX) given in the same Patent Publication, and at least one kind of these exemplified compounds, the rapid processing effect can be displayed.

Besides the above-described accelerators, the exemplified compounds given in JP OPI Publication No. 62-123459/1987, pp.51–115; the exemplified compound given in JP OPI Publication No. 63-17445/1988, pp.22–25; and the compounds given in JP OPI Publication Nos. 53-96530/1978 and 53-28426/1978, each may similarly be used.

A bleacher or a bleach-fixer may also contain, besides the above, a halide such as ammonium bromide, potassium bromide and sodium bromide, various kinds of fluorescent whitening agents, defoamers or surfactants.

When a processing agent relating to the invention is a fixer or a bleach-fixer, thiocyanates and thiosulfates are desirably used as fixing agents. Thiocyanates may desirably be contained in a proportion of at least not less than 0.1 mols/liter. When processing a color negative film, they are contained in a proportion of, more desirably, not less than 0.5 mols/liter and, particularly, not less than 1.0 mols/liter. Thiosulfates may be contained in a proportion of at least 0.2 mols/liter. When processing a color negative film, they may be contained more desirably in a proportion of not less than 0.5 mols/liter. Further in the invention, when making combination use of both thiocyanates and thiosulfates, the objects of the invention can further effectively be achieved.

The fixers or bleach-fixers each relating to the invention may contain a pH buffer comprising various kinds of salts independently or in combination, besides the above-mentioned fixing agents. It is further desired to contain therein a large number of rehalogenating agents including, for example, alkali halides or ammonium halides such as potassium bromide, sodium bromide, sodium chloride and ammonium bromide. It is also allowed to add suitably the compounds such as alkylamines and polyethylene oxides which have been known as the compounds to be ordinarily added to a fixer or a bleach-fixer.

It is desired that a fixer or a bleach-fixer is added by the compounds given in JP OPI Publication No. 64-295258/1989, which are represented by the following Formula (FA) and the exemplified compounds thereof. When this is the case, not only the effects of the invention can be displayed more effectively, but also another effect can also be so enjoyed as to remarkably reduce any sludges produced in a processing solution having a fixing function when a small quantity of light sensitive materials are processed extending for a long period of time.

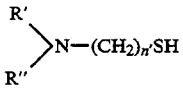

Formula (FA)

The compounds represented by Formula (FA) given in the above-mentioned Patent Publication can be synthesized in such an ordinary procedures described in U.S. Pat. Nos. 3,335,161 and 3,260,718. The compounds represented by the above-given Formula (FA) may be used independently or in combination. When these compounds are added in an amount within the range of 0.1 to 200 g per 1000 ml of a processing solution used, an excellent result can be enjoyed.

In the invention, it is desired that a stabilizer contains a chelating agent having a chelation stability constant of not less than 8 to ferric ions. The term, 'chelation stability constant' stated herein means a constant having been generally known from the literatures such as L. G. Sillen and A. E. Martell, "Stability Constants of Metal-ion Complexes", The Chemical Society, London (1964); S. Chaberek and A. E. Martell, "Organic Sequestering Agents", Wiley (1959); and so forth. The chelating agent having a chelation stability constant of not less than 8 to ferric ions include those described in JP Application Nos. 2-234776/1990 and JP OPI Publication No. 3-182750/1991. When these chelating agents are used in an amount within the range of, desirably, 0.01 to 50 g per 1000 ml of a stabilizer used and, more desirably, 0.05 to 20 g, an excellent result can be enjoyed.

The compounds desirably applicable to stabilizers include ammonium compounds. These compounds are supplied by the ammonium salts of various kinds of inorganic compounds. The ammonium compounds may be added in a proportion within the range of, desirably, 0.001 to 2.0 mols per 1000 ml of a stabilizer used and, more desirably, 0.002 mols to 1.0 mol. Further, the stabilizers are desired to contain a sulfite.

Still further, the stabilizers are desirable to contain a metal salt in combination with the foregoing chelating agents. The metal salts include Ba, Ca, Ce, Co, In, La, Mn, Ni, Bi, Pb, Sn, Zn, Ti, Zr, Mg, Al and Sr. They may be supplied in the forms of the inorganic salts such as a halide, a hydroxide, a sulfate, a carbonate, a phosphate and a acetate or a water-solubilizing chelating agent. They may be used in a proportion within the range of, desirably, $1\times10^{-4}$ to $1\times10^{-1}$ mols per 1000 ml of a stabilizer used and, more desirably, $4\times10^{-4}$ to $2\times10^{-2}$ mols.

The stabilizers may also be added by an organic salt (such as those of citric acid, acetic acid, succinic acid, oxalic acid and benzoic acid) and a pH controller (such as those of phosphate, borate, hydrochloride and sulfate).

In the invention, any publicly known antimolds may also be used independently or in combination, provided, the effects of the invention shall not be spoiled.

Next, the light sensitive materials applicable with the processing agents of the invention will now be detailed below.

When a light sensitive material is for photographic use, silver iodobromide or silver iodochloride each having an average silver iodide content of not less than 3 mol % may be used as the silver halide grains thereof. Among them, silver iodobromide containing silver iodide in a proportion within the range of 4 to 15 mol % may desirably be used. Particularly, the average silver iodide content thereof suitable for the invention are within the range of, desirably, 5 to 12 mol % and, preferably, 8 to 11 mol %.

As for the silver halide emulsions applicable to the light sensitive materials which are to be processed with the photographic processing agents of the invention, those described in Research Disclosure No. 308119 (hereinafter abbreviated to as RD308119) may be used. The places of the descriptions will be given below.

| [Item] | [Page of RD308119] |
|---|---|
| Iodine composition | 993 I-A |
| Preparation procedures | 993 I-A, 994 E |
| Crystal habit, | |
| Regular | 993 I-A |
| Twinned | " |
| Epitaxial | " |
| Halogen composition, | |
| Uniform | 993 I-B |
| Not uniform | " |
| Halogen conversion | 994 I-C |
| Halogen substitution | " |
| Metal content | 994 I-D |
| Monodispersion | 995 I-F |
| Solvent addition | " |
| Latent-image formed position, | |
| Surface | 995 I-G |
| Interior | " |
| Applicable light sensitive material, | |
| Negative | 995 I-H |
| Positive (including internally fogged grains) | " |
| Application upon mixing with emulsions | 995 I-J |
| Demineralization | 995 II-A |

As for the silver halide emulsions, those physically, chemically and spectrally sensitized are used. The additives applicable to the processing steps mentioned above are detailed in Research disclosure Nos. 17643, 18716 and 308119 (hereinafter abbreviated to as RD17643, RD18716 and RD308119, respectively). The places of the descriptions will be given below.

| [Item] | Page of [RD308119] | [RD17643] | [RD18716] |
|---|---|---|---|
| Chemical sensitizer | 996 III-A | 23 | 648 |
| Spectral sensitizer | 996 IV-A-A, B, C, D, E, H, I, J | 23~24 | 648~9 |
| Super sensitizer | 996 IV-A-E, J | 23~24 | 648~9 |
| Antifoggant | 998 VI | 24~25 | 649 |
| Stabilizer | 998 VI | 24~25 | 649 |

The photographic additives are also detailed in the above-given Research Disclosures. The places of the descriptions are given below.

| [Item] | Page of [RD308119] | [RD17643] | [RD18716] |
|---|---|---|---|
| Color-stain inhibitor | 1002 VII-I | 23 | 648 |
| Dye-image stabilizer | 1001 VII-J | 25 | |
| Whitening agent | 998 V | 24 | |
| UV absorbent | 1003 VIII C, XIII C | 25~26 | |
| Light absorbent | 1003 VIII | 25~26 | |
| Light diffuser | 1003 VIII | | |
| Filter dye | 1003 VIII | 25~26 | |
| Binder | 1003 IX | 26 | 651 |
| Antistatic agent | 1006 XIII | 27 | 650 |
| Layer hardener | 1004 X | 26 | 651 |
| Plasticizer | 1006 XII | 27 | 650 |
| Lubricant | 1006 XII | 27 | 650 |
| Activator, Coating aid | 1005 XI | 26~27 | 650 |
| Matting agent | 1007 X VI | | |
| Developing agent (contained in a light sensitive material) | 101 XX-B | | |

The light sensitive materials to be processed with the photographic processing agents of the invention can be applied with a variety of couplers. The typical examples of the couplers are given in the foregoing Research Disclosures. The places of the descriptions will be given below.

| [Item] | Page of [RD308119] | [RD17643] |
|---|---|---|
| Yellow coupler | 1001 VII-D | VII C~G |
| Magenta coupler | 1001 VII-D | VII C~G |
| Cyan coupler | 1001 VII-D | VII C~G |
| DIR coupler | 1001 VII-F | VII F |
| BAR coupler | 1002 VII-F | |
| Other useful residual group-releasing coupler | 1001 VII-F | |
| Alkali-soluble coupler | 1001 VII-E | |

The above-given additives may be added in the dispersion procedures detailed in RD308119, XIV and so forth.

In the invention, it is allowed to use the supports detailed in the foregoing RD17643, p.28, RD18716, pp.647-648 and RD308119, XIX.

The light sensitive materials can be provided with auxiliary layers such as a filter layer detailed in the foregoing RD308119, VII-K and an interlayer. Further, the light sensitive materials may take a variety of layer arrangements such as normal, reversal and unit layer arrangements Next, the color light sensitive materials desirably applicable with the photographic processing agents of the invention will be detailed below.

As for the silver halide grains contained in a light sensitive material, those principally comprising silver chloride of at least 80 mol % or more, desirably 90 mol % or more and, more desirably, 95 mol % or more, can be used.

The above-mentioned silver halide emulsions principally comprising silver chloride may further contain, besides silver chloride, silver bromide and/or silver iodide as the silver halide composition. In this case, the silver bromide content thereof is desirably not more than 3 mol %, more desirably, not more than 10 mol % and, further desirably, not more than 3 mol %. When containing silver iodide therein, the silver iodide content is, desirably, not more than 1 mol %, more desirably, not more than 0.5 mol % and, preferably, zero. The above-mentioned silver halide grains principally comprising silver chloride in a content of not more than 50 mol % are desirably applied to at least one silver halide emulsion layer and, more desirably, to the whole light-sensitive silver halide emulsion layer.

The crystals of the foregoing silver halide grains may be regularly crystallized, twin-crystallized or other. Any one of the desired ratios of [1.0.0] face to [1.1.1] face may be applied. Further, the crystal structures of these silver halide grains may be uniform from the interior to the exterior of the grains or may also be different in the layer (or phase) structures (of the core/shell type) between the interior and the exterior of the grains. Still further, these silver halide grains may be of the type of forming a latent image mainly on the surfaces of the grains or of the type of forming a latent image inside the grains. In addition to the above, tabular-shaped silver halide grains (see JP OPI Publication Nos. 58-113934/1983 and 61-47959/1986) may also be used. Besides the above, the silver halides detailed in JP OPI Publication Nos. 64-26837/1989, 64-26838/1989 and 64-77047/1989 may also be used.

The above-mentioned silver halide grains may be those prepared in any one of an acid process, a neutral process and an ammoniacal process. Or, they may also be prepared in such a manner that seed grains are prepared in an acid process and are then grown up in an ammoniacal process having a faster growing rate so as to grow them up to a desired size. When growing silver halide grains up, it is desired to control the pH and pAg in a reaction chamber and silver ions and halide ions are then jetted and mixed together in the chamber, successively and at the same time, so that the amounts of the ions jetted in may meet the growing rate of the silver halide grains, as described in, for example, JP OPI Publication No. 54-48521/1979.

EXAMPLES

The invention will now be detailed with reference to the examples of the invention. It is, however, to be understood that the invention shall not be limited to the following examples.

Example 1

Tablets were prepared in the procedures detailed in JP OPI Publication No. 3-141425/1991 by sufficiently mixing up the following color developer for color paper use so as to prepare a powdered processing agent for 10-liter use.

| <Powdered processing agent for 10-liter use · color developer> | |
|---|---|
| Potassium bromide | 0.2 g |
| Potassium chloride | 33 g |
| Potassium carbonate | 250 g |
| Potassium sulfite | 2 g |
| Sodium diethylenetriamine pentaacetate | 30 g |
| 1-(N-ethyl-N-methanesulfonamidoethyl)-3-methyl-p-phenylenediamine.3/2$H_2SO_4H_2O$ (CD-3) | 45 g |

-continued

| <Powdered processing agent for 10-liter use · color developer> | |
|---|---|
| Sodium hydrogencarbonate | 31 g |
| Diethylhydroxylamine.oxalic acid | 65 g |
| Compound represented by Formula (I) | See Table 4 |
| Thinopal SFP (manufactured by Ciba Geigy AG) | 25 g |

Every 20 tablets of the above-mentioned color developer were packed in one lot in a polyethylene bag and sealed. They were stored for 40 days at 50° C. and 65% RH. After the bags were cut open by a cutter, the contents were dissolved by a chemical mixer and the dissolving rates of the contents were each observed. After completing the dissolution, one liter each of the resulting color developers were taken and then put into a beaker having an open-aperture area ratio of 20 $cm^2$/liter. They were stored at 40° C. and the numbers of the days were counted until tar was produced.

The following color paper samples were prepared and exposed imagewise to light. The resulting exposed samples were subjected to the running tests upto 3 rounds through an automatic processor. The reflection magenta densities of the processed samples were measured in the unexposed areas. The results thereof are collectively shown in Table 4. The preparation and processing procedures for the color paper samples will be shown below.

Color Paper

Each of the layers having compositions shown in Tables 1 and 2 was provided onto a paper support laminated with polyethylene on one side and titanium oxide-containing polyethylene on the 1st layer on the other side, so that a color paper sample could be prepared. The coating solutions were prepared as follows.

Coating Solution for Layer 1

Each of 26.7 g of yellow coupler (Y-1), 10.0 g of dye-image stabilizer (ST-1), 6.67 g of dye-image stabilizer (ST-2) and 0.67 g of additive (HQ-1) was dissolved in 60 ml of ethyl acetate, followed by addition of high-boiling solvent (DNP) and the resulting solution was emulsionwise dispersed by a supersonic homogenizer in 220 ml of an aqueous 10% gelatin solution containing 7 ml of a 20% surfactant (SU-1) solution to obtain a yellow coupler dispersed solution. The resulting dispersed solution was mixed with a blue-sensitive silver halide emulsion (containing 10 g of silver) prepared under the following conditions, so that a coating solution for Layer 1 could be prepared.

The coating solutions for Layers 2 to 7 were each prepared in the same manner as in the above-mentioned coating solution for Layer 1.

As for the layer hardeners, (H-1) was added to each of Layers 2 and 4 and (H-2) to Layer 7, respectively. As for the coating aids, surfactants (SU-2) and (SU-3) were each added so as to adjust the surface tension.

TABLE 1

| Layer | Composition | Amount added ($g/m^2$) |
|---|---|---|
| Layer 7 | (Protective layer) | |
| | Gelatin | 1.00 |
| Layer 6 | (UV absorbing layer) | |
| | Gelatin | 0.40 |
| | UV absorbent (UV-1) | 0.10 |
| | UV absorbent (UV-2) | 0.04 |
| | UV absorbent (UV-3) | 0.16 |

TABLE 1-continued

| Layer | Composition | Amount added ($g/m^2$) |
|---|---|---|
| | Antistaining agent (HQ-1) | 0.01 |
| | DNP | 0.20 |
| | PVP | 0.03 |
| | Antiirradiation dye (AI-2) | 0.02 |
| Layer 5 | (Red-sensitive layer) | |
| | Gelatin | 1.30 |
| | Red-sensitive silver chlorobromide emulsion (Em-R) | 0.21* |
| | Cyan coupler (C-1) | 0.17 |
| | Cyan coupler (C-2) | 0.25 |
| | Dye-image stabilizer (ST-1) | 0.20 |

TABLE 1-continued

| Layer | Composition | Amount added ($g/m^2$) |
|---|---|---|
| | Antistaining agent (HQ-1) | 0.01 |
| | HBS-1 | 0.20 |
| | DOP | 0.20 |
| Layer 4 | (UV absorbing layer) | |
| | Gelatin | 0.94 |
| | UV absorbent (UV-1) | 0.28 |
| | UV absorbent (UV-2) | 0.09 |
| | UV absorbent (UV-3) | 0.38 |
| | Antistaining agent (HQ-1) | 0.03 |
| | DNP | 0.40 |

TABLE 2

| Layer | Composition | Amount added ($g/m^2$) |
|---|---|---|
| Layer 3 | (Green-sensitive layer) | |
| | Gelatin | 1.40 |
| | Green-sensitive silver chlorobromide emulsion (Em-G), in terms of silver content | 0.19 |
| | Magenta coupler (M-1) | 0.35 |
| | Dye-image stabilizer (ST-3) | 0.15 |
| | Dye-image stabilizer (ST-4) | 0.15 |
| | Dye-image stabilizer (ST-5) | 0.15 |
| | DNP | 0.20 |
| | Anti-irradiation dye (AI-1) | 0.01 |
| Layer 2 | (Interlayer) | |
| | Gelatin | 1.20 |
| | Antistaining agent (HQ-2) | 0.12 |
| | DIDP | 0.15 |
| Layer 1 | (Blue-sensitive layer) | |
| | Gelatin | 1.20 |
| | Blue-sensitive silver chlorobromide emulsion (EmA), in terms of silver content | 0.26 |
| | Yellow coupler (Y-1) | 0.80 |
| | Dye-image stabilizer (ST-1) | 0.30 |
| | Dye-image stabilizer (ST-2) | 0.20 |
| | Antistaining agent (HQ-1) | 0.02 |
| | Anti-irradiation dye (AI-3) | 0.01 |
| | DNP | 0.20 |
| Support | Polyethylene-laminated paper | |

Y-1

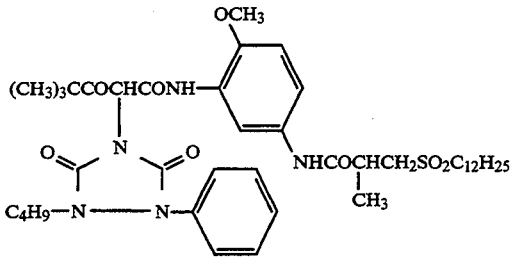

M-1

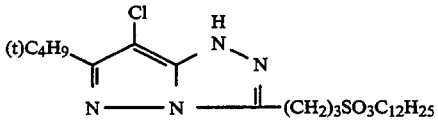

C-1

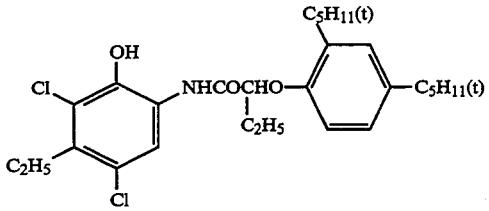

C-2

TABLE 2-continued
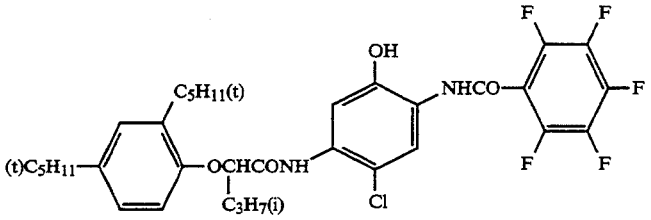
ST-1
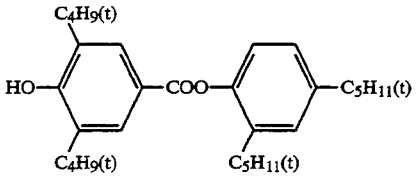
ST-2
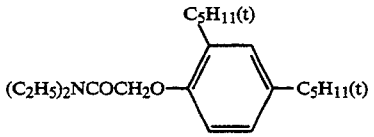
ST-3
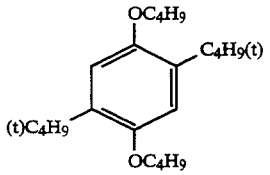
ST-4
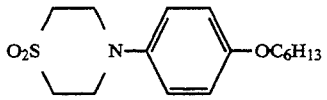
ST-5
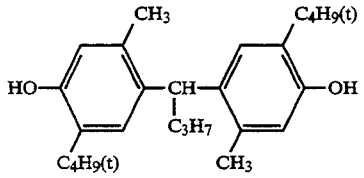
UV-1
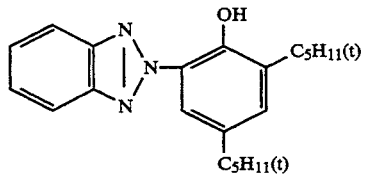
UV-2
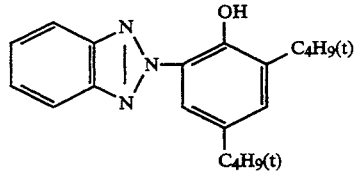
UV-3

TABLE 2-continued
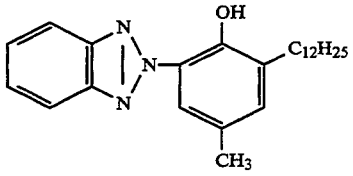
DOP Dioctyl phthalate
DNP Dinonyl phthalate
DIDP Diisodecyl phthalate
PVP Polyvinyl pyrrolidone
HQ-1
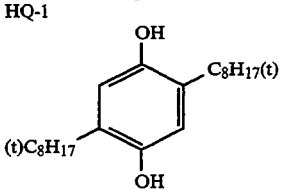
HQ-2
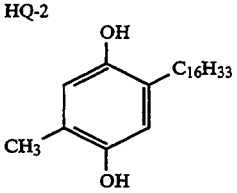
HBS-1
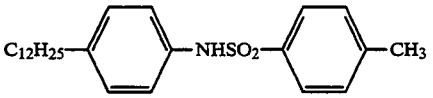
AI-1
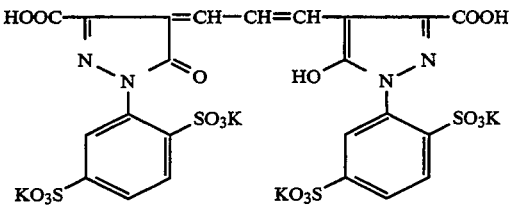
AI-2
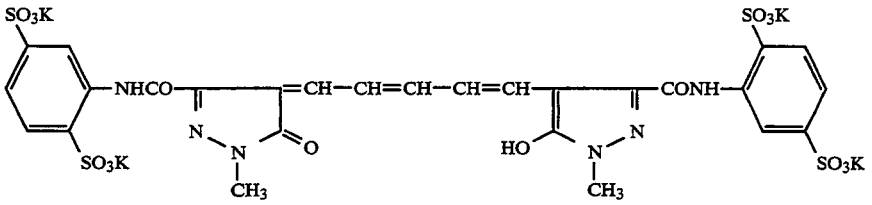
AI-3
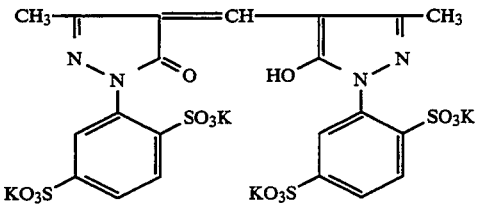
SU-1
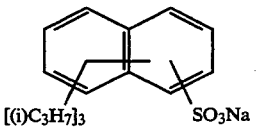

TABLE 2-continued

SU-2

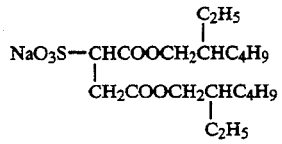

SU-3

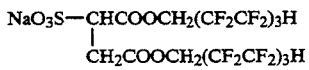

H-1

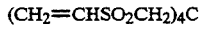

H-2

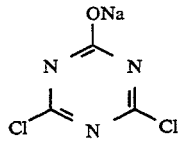

Preparation of Blue-Sensitive Silver Halide Emulsion

Into 1000 ml of an aqueous 2% gelatin solution kept at 40 ° C., the following (Solution A) and (Solution B) were added at the same time by taking 30 minutes while controlling pAg and pH to be 6.5 and 3.0, respectively and, then, the following (Solution C) and (Solution D) were added at the same time by taking 180 minutes while controlling pAg and pH to be 7.3 and 5.5, respectively. At this time, each of the pAg values was controlled in the procedures detailed in JP OPI Publication No. 59-45437/1984 and each of the pH values was controlled by making use of an aqueous sulfuric acid or sodium hydroxide solution.

| | |
|---|---|
| (Solution A) | |
| Sodium chloride | 3.42 g |
| Potassium bromide | 0.03 g |
| Add water to make | 200 ml |
| (Solution B) | |
| Silver nitrate | 10 g |
| Add water to make | 200 ml |
| (Solution C) | |
| Sodium chloride | 102.7 g |
| Potassium bromide | 1.0 g |
| Add water to make | 600 ml |
| (Solution D) | |
| Silver nitrate | 300 g |
| Add water to make | 600 ml |

After completing the addition, a desalinization was carried out by making use of an aqueous solution of 5% Demol N (manufactured by Kao-Atlas Co.) and an aqueous solution of 20% magnesium sulfate, and then an aqueous gelatin solution was mixed therein to obtain a monodisperse type cubic emulsion EMP-1 having an average grain size of 0.85 μm, a variation coefficient of 0.07 and a silver chloride content of 99.5 mol %.

The resulting emulsion EMP-1 was chemically ripened at 50 ° C. for 90 minutes with the following compounds, so that a blue-sensitive silver halide emulsion (Era-B) was obtained.

| | |
|---|---|
| Sodium thiosulfate | 0.8 mg/mol of AgX |
| Chloroauric acid | 0.5 mg/mol of AgX |
| Stabilizer (STAB-1) | $6 \times 10^{-4}$ mols/mol of AgX |
| Sensitizing dye (BS-1) | $4 \times 10^{-4}$ mols/mol of AgX |
| Sensitizing dye (BS-2) | $1 \times 10^{-4}$ mols/mol of AgX |

Preparation of Green-Sensitive Silver Halide Emulsion

Monodisperse type cubic emulsion EMP-2 having an average grain size of 0.43 μm, a variation coefficient of 0.08 and a silver chloride content of 99.5 mol % was obtained in the same manner as in EMP-1, except that the time of adding (Solution A) and (Solution B) and the time of adding (Solution C) and (Solution D) were changed.

The resulting EMP-2 was chemically ripened at 65° C. for 120 minutes by making use of the following compounds, so that a green-sensitive silver halide emulsion (Em-G) was obtained.

| | |
|---|---|
| Sodium thiosulfate | 1.5 mg/mol of AgX |
| Chloroauric acid | 1.0 mg/mol of AgX |
| Stabilizer (STAB-1) | $6 \times 10^{-4}$ mols/mol of AgX |
| Sensitizing dye (GS-1) | $4 \times 10^{-4}$ mols/mol of AgX |

Preparation of Red-Sensitive Silver Halide Emulsion

Monodisperse type cubic emulsion EMP-3 having an average grain size of 0.50 μm, a variation coefficient of 0.08 and a silver chloride content of 99.5 mol % was obtained in the same manner as in EMP-1, except that the time of adding (Solution A) and (Solution B) and the time of adding (Solution C) and (Solution D) were changed.

The resulting EMP-3 was chemically ripened at 60° C. for 90 minutes by making use of the following compounds, so that a red-sensitive silver halide emulsion (Em-R) was obtained.

| | |
|---|---|
| Sodium thiosulfate | 1.8 mg/mol of AgX |
| Chloroauric acid | 2.0 mg/mol of AgX |

-continued

| | |
|---|---|
| Stabilizer (STAB-1) | $6 \times 10^{-4}$ mols/mol of AgX |
| Sensitizing dye (RS-1) | $4 \times 10^{-4}$ mols/mol of AgX |

BS-1

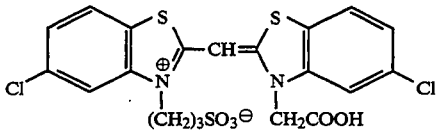

BS-2

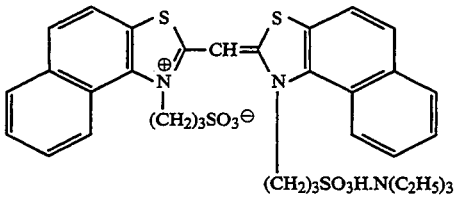

GS-1

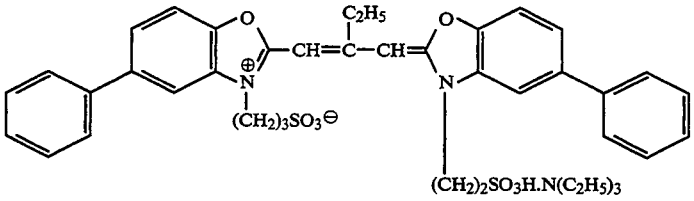

RS-1

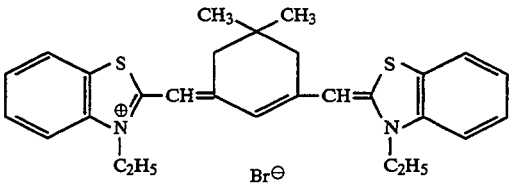

STAB-1

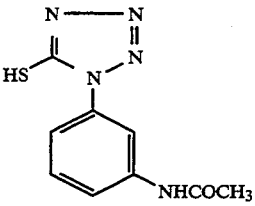

The resulting samples were each exposed wedgewise to light in an ordinary procedures and were then running treated according to the following processing steps.

TABLE 3

| Processing step | Temperature | Processing time |
|---|---|---|
| Color developing | 38 ± 0.3° C. | 30 sec. |
| Bleach-fixing | 38 ± 3° C. | 30 sec. |
| Stabilizing* | 38 ± 5° C. | 20 sec. × 3 |
| Drying | 60 ± 5° C. | 45 sec. |

*The stabilizing tank unit was comprised of three tanks. The replenisher was supplied to the third tank (that was the final tank). Each of the overflows was flowed in order into the precedent tank (that is so-called a counter-current system).

The processing solutions used in the respective processing steps will be given below.

A color developer solution dissolved the above-described color developer (in the tablet form) was used.

| Bleach-fixer | |
|---|---|
| Water | 700 g |
| Ferric ammonium ethylenediamine tetraacetate | 75 g |
| Ethylenediamine tetraacetic acid | 2 g |
| Ammonium thiosulfate | 50 g |
| Ammonium thiocyanate | 30 g |
| Potassium sulfite | 10 g |
| p-toluene sulfinic acid | 5 g |
| Ammonium bromide | 10 g |
| Add water to make | 1000 ml |
| Adjust pH with acetic acid or sodium hydroxide to be | pH= 6.5 |
| The stabilizer used therein was as follows. | |
| Water | 800 g |
| 1,2-benzoisothiazoline-3-one | 0.1 g |
| 1-hydroxyethylidene-1,1-diphosphonic acid | 5.0 g |
| Ethylenediamine tetraacetic acid | 1.0 g |
| Cinopar SEP (manufactured by Ciba Geigy AG) | 2.0 g |
| Ammonium sulfate | 2.5 g |
| Zinc chloride | 1.0 g |
| Magnesium chloride | 0.5 g |
| o-phenylphenol | 1.0 g |
| Sodium sulfite | 2.0 g |
| Add water to make | 1000 ml |

-continued

| Bleach-fixer | |
|---|---|
| Adjust pH with a 50% sulfuric acid solution or a 25% aqueous ammonia to be | pH= 8.0 |

TABLE 4

| Experiment No. | Inventive compound or Comparative compound Kind | Amount added (g/l) | Tablet dissolving rate** (in relative values) | Day numbers to produce tar in storage | Magenta reflection density in unexposed area | Remarks |
|---|---|---|---|---|---|---|
| 1-1 | — | — | 100 (Criterion) | 7 | 0.07 | Comparison |
| 1-2 | PEG1540*(in solid) | 5 | 85 | 10 | 0.05 | Comparison |
| 1-3 | PEG1540*(in solid) | 10 | 80 | 13 | 0.04 | Comparison |
| 1-4 | PEG1540*(in solid) | 20 | 90 | 15 | 0.04 | Comparison |
| 1-5 | PEG1540*(in solid) | 50 | — | — | — | Comparison (PEG1540, not completely dissolved) |
| 1-6 | Exemplified inventive compound (I-32) | 5 | 75 | 14 | 0.03 | Invention |
| 1-7 | Exemplified inventive compound (I-32) | 10 | 65 | 20 | 0.02 | Invention |
| 1-8 | Exemplified inventive compound (I-32) | 20 | 55 | 30 | 0.01 | Invention |
| 1-9 | Exemplified inventive compound (I-32) | 50 | 50 | 30 | 0.01 | Invention |
| 1-10 | Exemplified inventive compound (I-32) | 70 | 50 | 31 | 0.01 | Invention |
| 1-11 | Exemplified inventive compound (I-32) | 80 | 60 | 31 | 0.02 | Invention |
| 1-12 | Exemplified inventive compound (I-32) | 100 | 65 | 31 | 0.03 | Invention |
| 1-13 | Exemplified inventive compound (I-16) | 50 | 53 | 29 | 0.01 | Invention |
| 1-14 | Exemplified inventive compound (I-17) | 50 | 55 | 30 | 0.01 | Invention |
| 1-15 | Exemplified inventive compound (I-18) | 50 | 50 | 31 | 0.01 | Invention |
| 1-16 | Exemplified inventive compound (I-48) | 50 | 65 | 28 | 0.02 | Invention |
| 1-17 | Exemplified inventive compound (I-49) | 50 | 63 | 29 | 0.02 | Invention |

*PEG1540: Polyethylene diglycol (with a weight average molecular weight of 1540)
**The tablet dissolving rates were indicated by a relative values to that of 1-1 regarded as a value of 100 (as the criterion); It means the smaller a figure is, the shorter a dissolving time is.

As is obvious from Table 4, it can be found that the invention provides a photographic processing agent in which the solubility can remarkably be improved, and occurrence of tar and stain can also be prevented.

Further, when making use of the photographic processing agents of the invention, any plastic bottle containing the concentrated solution of a photographic processing agent, which has conventionally been used so far, is not necessary and, therefore, the amount of plastics used could be reduced to the extent of about 1/5 to 1/30 and the volume of a processing agent kit could also be reduced to 3/1 to 1/10.

Example 2

As shown in Table 5, the tablets each having the different bulk densities were prepared by changing the pressures applied when making tablets under the same conditions as in Experiment No. 1–9 of Example 1. By using the resulting tablets, the same experiments as in Example 1 were carried out.

The results thereof are shown in Table 5.

TABLE 5

| Experiment No. | Bulk density ($g/cm^2$) | Tablet dissolving rate (in relative value) |
|---|---|---|
| 2-1 | 10.0 | 100 (as criterion) |
| 2-2 | 6.0 | 80 |
| 2-3 | 5.0 | 75 |
| 2-4 | 3.0 | 70 |
| 2-5 | 1.8 | 68 |
| 2-6 | 1.0 | 65 |
| 2-7 | 0.5 | 63 |

The tablet dissolving rates are indicated by the relative values to the value obtained from Experiment No. 2-1 regarded as a value of 100 (as the criterion). (It indicates that the smaller a figure is, the shorter a dissolving time is.)

Results

On the numbers of days until tar was produced in storage and the magenta density in the unexposed areas, there was no significant difference due to the bulk densities.

When trying the abrasion-crashing tests of Experiment No. 2–7, the corners of the tablets were undesirably broken a little when taking the tablets out of the packaging material cut off by a cutter. When trying the same tests of other Experiment Nos., the corners of the tablets were satisfactory in the shape-keeping and handling properties without being broken, so that no significant difference could be produced by the bulk densities.

On a tablet dissolving rate, it can be found from Table 5 that the smaller a bulk density is, the more a tablet dissolving rate can be so effective as to be greatly improved by 20 to 35%.

As described above, it can be found that the tablet dissolving rate of a tablet can be satisfactory when the bulk density thereof is within the range of 1.0 to 6.0 g/cm$^2$.

Example 3

The same experiments as in Example 1 were tried, except that Thinopal SEP contained in the color developer used each in Experiments No. 1–9 of Example 1 was replaced by those shown in Table 6. The results thereof are collectively shown in Table 6.

Experimental fluorescent whitening agents shown in Table 6

(1)

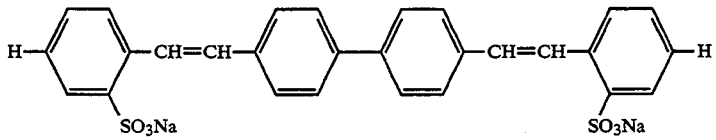

(2)

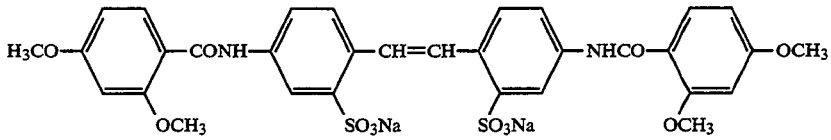

(3)

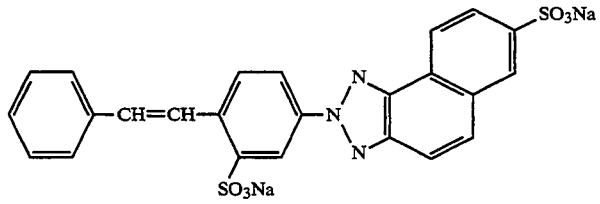

TABLE 6

| Experiment No. | Fluorescent whitening agent | Tablet dissolving rate (in relative value)* | Day number until tar produced | Maganta density in unexposed area |
|---|---|---|---|---|
| 3-1 | For experiment (1) | 105 | 29 | 0.03 |
| 3-2 | For experiment (2) | 104 | 29 | 0.03 |
| 3-3 | For experiment (3) | 105 | 29 | 0.03 |
| 3-4 | Not added | 110 | 28 | 0.04 |
| 3-5 | E-2 | 110 | 30 | 0.02 |
| 3-6 | E-4 | 98 | 32 | 0.01 |
| 3-7 | E-10 | 100 | 32 | 0.01 |
| 3-8 | E-40 | 101 | 30 | 0.01 |
| 3-9 | E-42 | 100 | 30 | 0.02 |
| 3-10 | E-44 | 98 | 30 | 0.01 |
| 3-11 | E-24 | 99 | 31 | 0.01 |
| 3-12 | E-34 | 100 (as criterion) | 30 | 0.01 |
| 3-13 | E-43 | 99 | 32 | 0.01 |
| 3-14 | E-35 | 102 | 31 | 0.02 |
| 3-15 | E-37 | 100 | 32 | 0.01 |
| 3-16 | E-41 | 99 | 31 | 0.01 |

*Tablet dissolving rates are indicated by the relative values to the value of Experiment No. 3-12 regarded as a value of 100 (as the criterion)

It can be found from the above-given Table 6 that, when the processing agents of the invention are used with a specific fluorescent whitening agent in combination, the effects of the invention can more satisfactorily be displayed.

Example 4

A color negative film was prepared in the following manner.

Amounts of the materials added into the silver halide photographic light sensitive material are indicated in the terms of grams per sq. meter unless otherwise expressly stated. The silver halides and colloidal silver are each indicated by converting them into the silver contents.

Color Negative Film

A subbing treatment was subjected onto one side (the front surface) of a (50 μ-thick) triacetyl cellulose film support. Next, each of the layers having the following compositions was formed, in order from the support side, on the subbed front side and the other side (the back side opposite to the subbed side) by interposing the support between the both sides.

| | |
|---|---|
| Back side layer 1 | |
| Alumina-sol AS-100 (aluminium oxide), (manufactured by Nissan Chemical Ind. Co., Ltd.) | 0.8 g |
| Back side layer 2 | |

-continued

| | |
|---|---|
| Diacetyl cellulose | 100 mg |
| Stearic acid | 10 mg |
| Fine silica particles (having an average particle size of 0.2 μm) | 50 mg |

Next, a multilayered color photographic light sensitive material was prepared by forming each of the layers having the following compositions, in order from the support side, on the subbed front side.

| | |
|---|---|
| Layer 1: An antihalation layer (HC) | |
| Black colloidal silver | 0.15 g |
| UV absorbent (UV-4) | 0.20 g |
| Colored cyan coupler (CC-1) | 0.02 g |
| High boiling solvent (Oil-1) | 0.20 g |
| High boiling solvent (Oil-2) | 0.20 g |
| Gelatin | 1.6 g |
| Layer 2: An interlayer (IL-1) | |
| Gelatin | 1.3 g |
| Layer 3: A low speed red-sensitive emulsion layer (RL) | |
| Silver iodobromide emulsion (having an average grain size of 0.3 μm) | 0.42 g |
| Silver iodobromide emulsion (having an average grain size of 0.4 μm) | 0.28 g |
| Sensitizing dye (S-1) | $3.2 \times 10^{-4}$ mols/mol of silver |
| Sensitizing dye (S-2) | $3.2 \times 10^{-4}$ mols/mol of silver |
| Sensitizing dye (S-3) | $0.2 \times 10^{-4}$ mols/mol of silver |
| Cyan coupler (C-3) | 0.50 g |
| Cyan coupler (C-4) | 0.13 g |
| Colored cyan coupler (CC-1) | 0.07 g |
| DIR compound (D-1) | 0.006 g |
| DIR compound (D-2) | 0.01 g |
| High boiling solvent (Oil-1) | 0.55 g |
| Gelatin | 1.0 g |
| Layer 4: A high speed red-sensitive emulsion layer (RH) | |
| Silver iodobromide emulsion (having an average grain size of 0.7 μm) | 0.91 g |
| Sensitizing dye (S-1) | $1.7 \times 10^{-4}$ mols/mol of silver |
| Sensitizing dye (S-2) | $1.6 \times 10^{-4}$ mols/mol of silver |
| Sensitizing dye (S-3) | $0.1 \times 10^{-4}$ mols/mol of silver |
| Cyan coupler (C-4) | 0.23 g |
| Colored cyan coupler (CC-1) | 0.03 g |
| DIR compound (D-2) | 0.02 g |
| High boiling solvent (Oil-1) | 0.25 g |
| Gelatin | 1.0 g |
| Layer 5: An interlayer (IL-2) | |
| Gelatin | 0.8 g |
| Layer 6: A low speed green-sensitive emulsion layer (GL) | |
| Silver iodobromide emulsion (having an average grain size of 0.4 μm) | 0.6 g |
| Silver iodobromide emulsion (having an average grain size of 0.3 μm) | 0.2 g<br>0.2 g |
| Sensitizing dye (S-4) | $6.7 \times 10^{-4}$ mols/mol of silver |
| Sensitizing dye (S-5) | $0.8 \times 10^{-4}$ mols/mol of silver |
| Magenta coupler (M-2) | 0.17 g |
| Magenta coupler (M-3) | 0.43 g |
| Colored magenta coupler (CM-1) | 0.10 g |
| DIR compound (D-3) | 0.02 g |
| High boiling solvent (Oil-2) | 0.7 g |
| Gelatin | 1.0 g |
| Layer 7: A high speed green-sensitive emulsion layer (GH) | |
| Silver iodobromide emulsion (having an average grain size of 0.7 μm) | 0.91 g |
| Sensitizing dye (S-6) | $1.1 \times 10^{-4}$ mols/mol of silver |
| Sensitizing dye (S-7) | $2.0 \times 10^{-4}$ mols/mol of silver |
| Sensitizing dye (S-8) | $0.3 \times 10^{-4}$ mols/mol of silver |
| Magenta coupler (M-2) | 0.30 g |
| Magenta coupler (M-3) | 0.13 g |
| Colored magenta coupler (CM-1) | 0.04 g |
| DIR compound (D-3) | 0.004 g |
| High boiling solvent (Oil-2) | 0.35 g |
| Gelatin | 1.0 g |
| Layer 8: A yellow filter layer (YC) | |
| Yellow colloidal silver | 0.1 g |
| Additive (HS-1) | 0.07 g |
| Additive (HS-2) | 0.07 g |
| Additive (HC-1) | 0.12 g |

-continued

| | |
|---|---|
| High boiling solvent (Oil-2) | 0.15 g |
| Gelatin | 1.0 g |
| Layer 9: A low speed blue-sensitive emulsion layer (BL) | |
| Silver iodobromide emulsion (having an average grain size of 0.3 μm) | 0.25 g |
| Silver iodobromide emulsion (having an average grain size of 0.4 μm) | 0.25 g |
| Sensitizing dye (S-9) | $5.8 \times 10^{-4}$ mols/mol of silver |
| Yellow coupler (Y-2) | 0.6 g |
| Yellow coupler (Y-3) | 0.32 g |
| DIR compound (D-1) | 0.003 g |
| DIR compound (D-2) | 0.006 g |
| High boiling solvent (Oil-2) | 0.18 g |
| Gelatin | 1.3 g |
| Layer 10: A high speed blue-sensitive emulsion layer (BH) | |
| Silver iodobromide emulsion (having an average grain size of 0.8 μm) | 0.5 g |
| Sensitizing dye (S-10) | $3.0 \times 10^{-4}$ mols/mol of silver |
| Sensitizing dye (S-11) | $1.2 \times 10^{-4}$ mols/mol of silver |
| Yellow coupler (Y-2) | 0.18 g |
| Yellow coupler (Y-3) | 0.10 g |
| High boiling solvent (Oil-2) | 0.05 g |
| Gelatin | 1.0 g |
| Layer 11: Protective layer 1 (PRO-1) | |
| Silver iodobromide | 0.3 g |
| UV absorbent (UV-4) | 0.07 g |
| UV absorbent (UV-5) | 0.10 g |
| Additive (HS-1) | 0.2 g |
| Additive (HS-2) | 0.1 g |
| High boiling solvent (Oil-1) | 0.07 g |
| High boiling solvent (Oil-3) | 0.07 g |
| Gelatin | 0.8 g |
| Layer 12: Protective layer 2 (PRO-2) | |
| Lubricant (WAX-1) | 0.04 g |
| Activator (SU-1) | 0.004 g |
| Polymethyl methacrylate (having an average particle size of 3 μm) | 0.02 g |
| Copolymer of methyl methacrylate: Ethyl methacrylate:Methacrylic acid = 3:3:4 (in weight ratio) (having an average particle size of 3 μm) | 0.13 g |

The above-described color negative film further contained compounds SU-1 and SU-4, a viscosity controller, layer hardeners H-1 and H-2, stabilizer STAB-2, antifoggants A/F-1 and AF-2 (having a weight average molecular weight of 10,000 and 1,100,000, respectively), dyes AI-4 and AI-5 and compound DI-1 (in an amount of 9.4 mg/m$^2$).

C-3

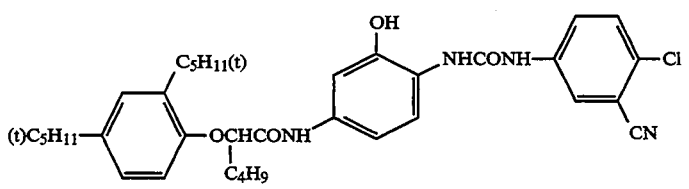

C-4

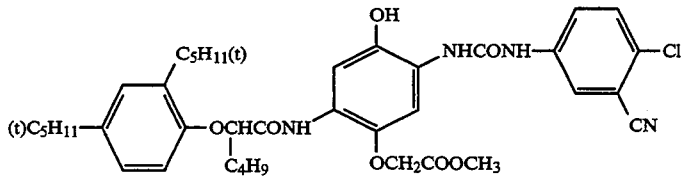

M-2

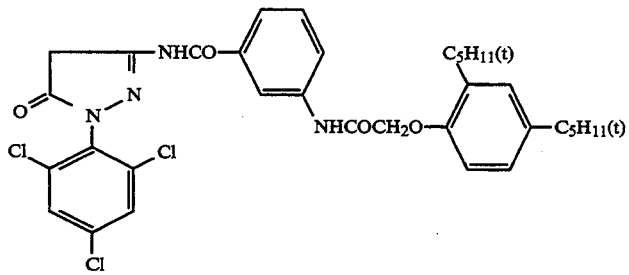

-continued
M-3
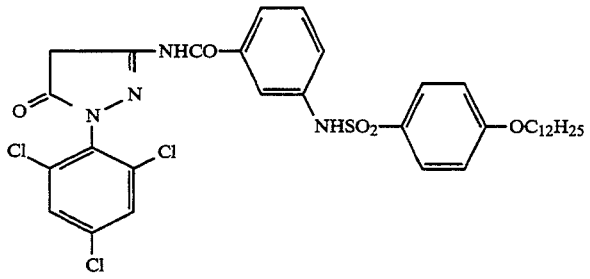
Y-2
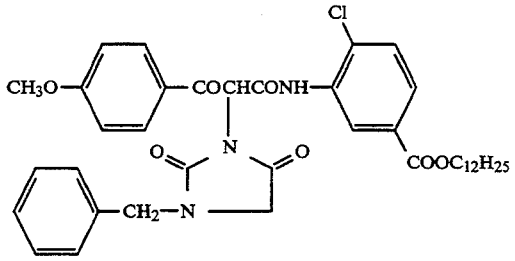
Y-3
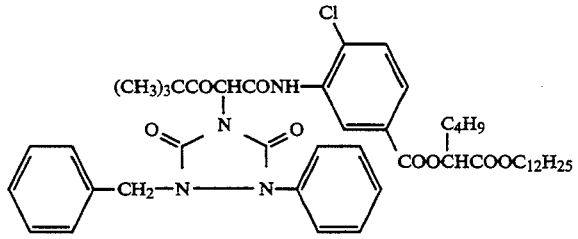
CC-1
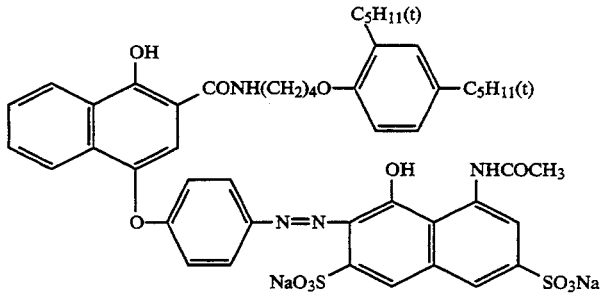
CM-1
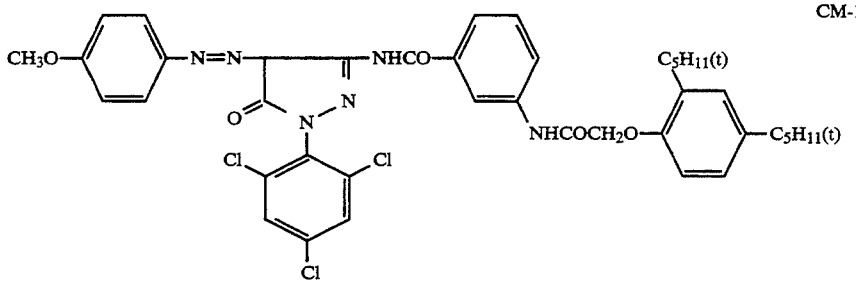

-continued
D-1
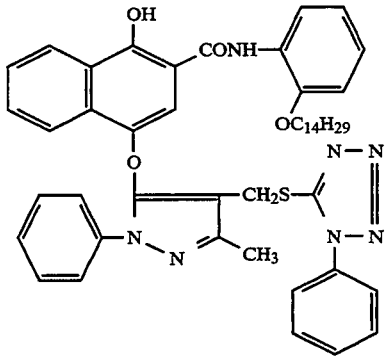
D-2
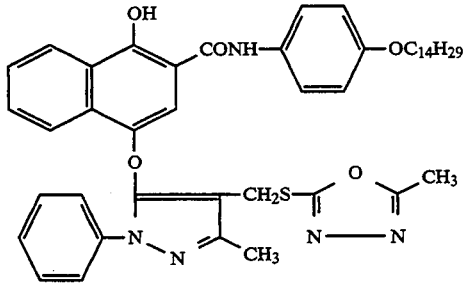
D-3
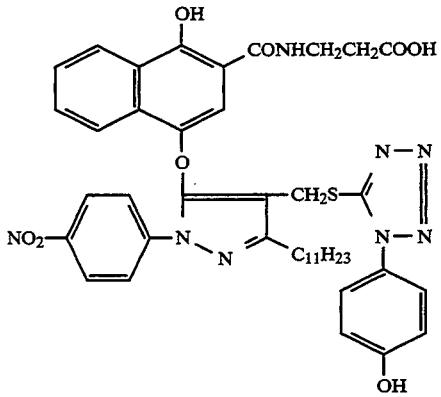
UV-4
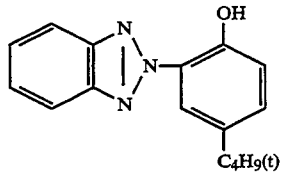
UV-5
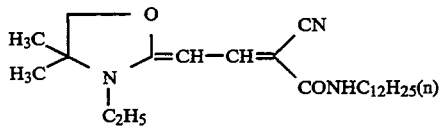
S-1
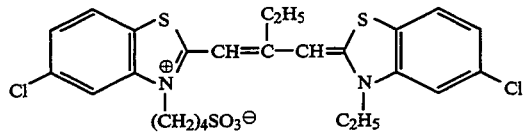
S-2
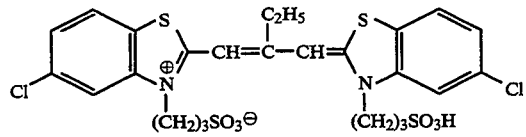

-continued
S-3
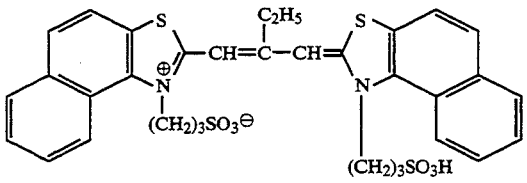
S-4
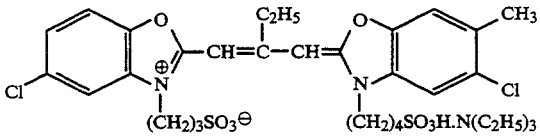
S-5
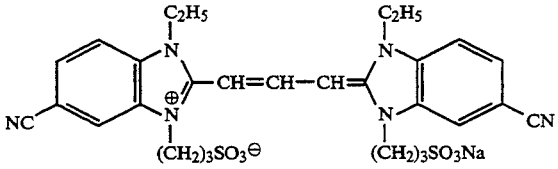
S-6
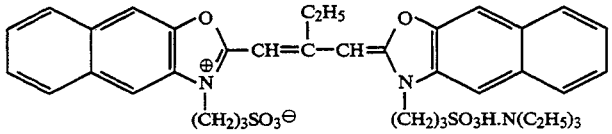
S-7
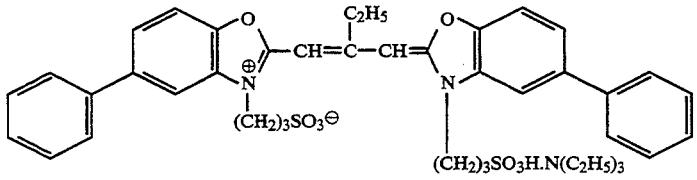
S-8
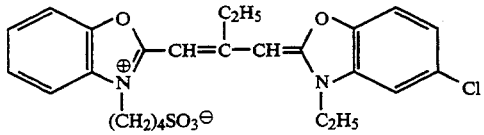
S-9
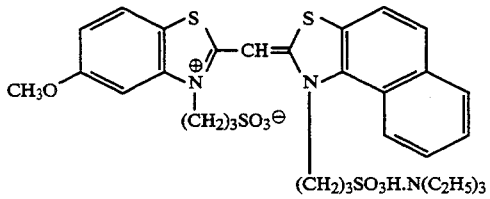
S-10
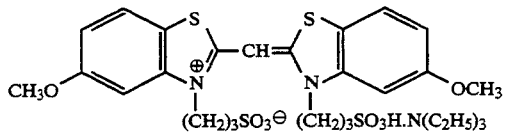
S-11
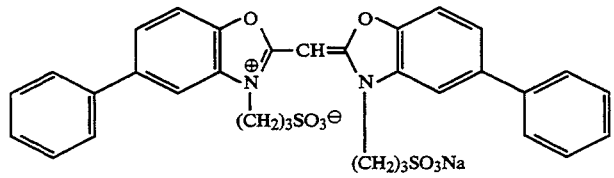

-continued
HS-1
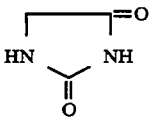
H-2
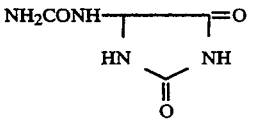
SC-1
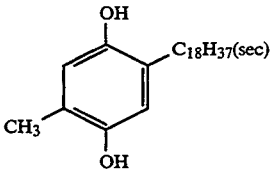
and
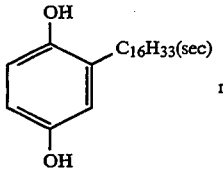
mixture of 2:3
Oil-1
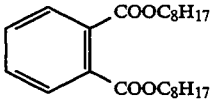
Oil-2
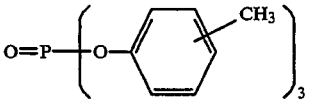
Oil-3
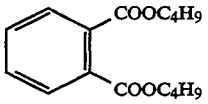
H-1
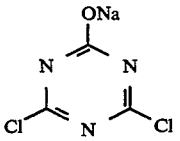
$(CH_2{=}CHSO_2CH_2)_2O$ H-2
SU-1
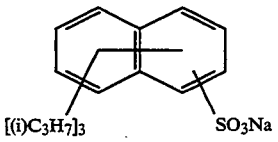
SU-4
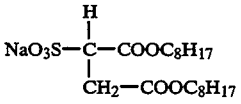
AI-4
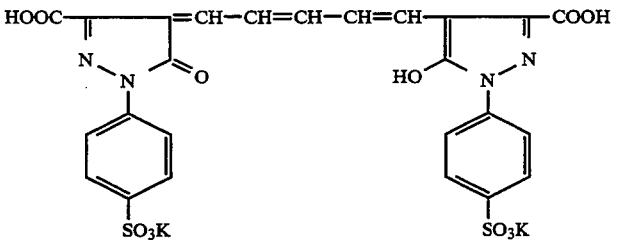

-continued

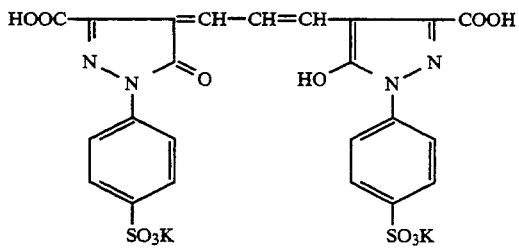

AI-5

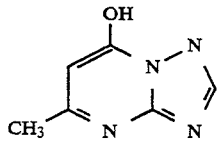

STAB-2

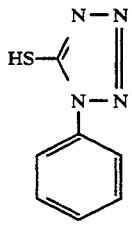

AF-1

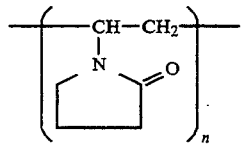

AF-2

Lubricant

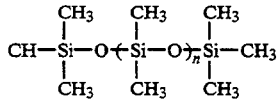

(WAX-1)

Weight average molecular weight = 30,000

(A mixture of the following 3 components)

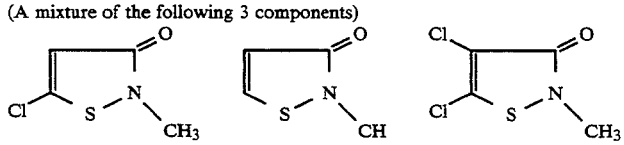

DI-1

(Component A) (Component B) (Component C)

A:B:C = 50:46:4 (in mol ratio)

Preparation of Emulsion

The silver iodobromide emulsion used in layer 10 was prepared in the following procedures.

Monodisperse type silver iodobromide grains having an average grain size of 033 μm (having a silver iodide content of 2 mol %) were served as the seed Crystals, so that the silver iodobromide emulsion could be prepared in a double-jet method.

While keeping solution <G-1> at a temperature of 70° C., a pAg of 7.8 and pH of 7.0, the seed emulsion equivalent to 0.34 mols was added thereto while stirring well.

(Formation of an Internal High-Iodine Phase -a Core Phase-)

After completing the above procedures, <H-1> and <S-1> were then added at an accelerated flow rate (the final flow rate was 3.6 times as faster as the initial rate) by taking 86 minutes, while keeping the flow rate ratio of 1:1.

(Formation of External Low-Iodine Phase -a Shell Phase-)

Successively, <H-2> and <S-2> were then added at an accelerated flow rate (the final flow rate was 5.2 times as faster as the initial rate) by taking 65 minutes, while keeping the flow rate ratio of 1:1.

The pAg and pH in the course of forming grains were each controlled with an aqueous potassium bromide solution and an aqueous 56% acetic acid solution. A washing treatment was applied in an ordinary flocculation process and gelatin was then added thereto so as to be redispersed. After then, the pAg and pH were adjusted to be 5.8 and 8.06 at 40° C., respectively.

The resulting emulsion was proved to be a monodisperse type emulsion containing octahedral silver iodobromide grains having an average grain size of 0.80 μm, a distribution range of 12.4% and a silver iodide content of 8.5 mol %.

| | |
|---|---|
| <G-1> | |
| Ossein gelatin | 100.0 g |
| A 10 wt % methanol solution containing Compound-1 (described below) | 25.0 ml |
| A 28% aqueous ammonia solution | 440.0 ml |
| An aqueous 56% acetic acid solution | 660.0 ml |
| Add water to make | 5000.0 ml |
| <H-1> | |
| Ossein gelatin | 82.4 g |
| Potassium bromide | 151.6 g |
| Potassium iodide | 90.6 g |
| Add water to make | 1030.5 ml |
| <S-1> | |
| Silver nitrate | 309.2 g |
| A 28% aqueous ammonia solution | Equivalent |
| Add water to make | 1030.5 ml |
| <H-2> | |
| Silver nitrate | 302.1 g |
| Potassium bromide | 770.0 g |
| Potassium iodide | 33.2 g |
| Add water to make | 3776.8 ml |
| <S-2> | |
| Silver nitrate | 1133.0 g |
| A 28% aqueous ammonia solution | Equivalent |
| Add water to make | 3776.8 ml |
| Compound-1 $HO(CH_2CH_2O)_m[CH(CH_3)CH_2O]_{17}(CH_2CH_2O)_nH$ (An average molecular weight ÷ 1300) | |

In the similar method, the average-crystal size, temperature, pAg, pH, flow rate, adding time and halide composition of the seed crystals were each changed, so that each of the above-mentioned emulsions having the different average grain sizes and silver iodide contents could be prepared.

Each of the resulting emulsions was proved to be a core/shell type monodispersed emulsion having a distribution range of not wider than 20%. Each of the emulsions was subjected to an optimum chemical ripening treatment in the presence of sodium thiosulfate, chloroauric acid and ammonium thiocyanate and sensitizing dyes, 4-hydroxy-6-methyl-1,3,3a,7-tetrazaindene and 1-phenyl-5-mercaptotetrazole were added thereto.

The resulting color film samples prepared in the above-mentioned manner were each exposed to light wedgewise in an ordinary method and were then processed in the following processing steps.

TABLE 7

| Processing step | Temperature | Processing time |
|---|---|---|
| Color developing | 38 ± 0.3° C. | 3 min. 15 sec. |
| Bleaching | 38 ± 2.0° C. | 45 sec. |
| Fixing | 38 ± 2.0° C. | 1 min. 30 sec. |
| Stabilizing* | 38 ± 5.0° C. | 30 sec. in Tank 1<br>30 sec. in Tank 2 |
| Drying | 60 ± 5° C. | 1 min. |

*Tanks 1 and 2 of the stabilizing tank were arranged to be a counter-current system and the replenisher was replenished into Tank 2.

The processing solutions used in the processing steps were as follows.

| | |
|---|---|
| <Color developer> (In a tablet type for 1 liter use) | |
| Potassium carbonate | 30 g |
| Sodium hydrogen carbonate | 3.5 g |
| Sodium 1-hydroxyethane-1,1-diphosphonate | 2.5 g |
| Sodium diethylenetriamine pentaacetate | 2.0 g |
| 4-amino-3-methyl-N-ethyl-N-(β-hydroxyethyl) aniline sulfate | 4.8 g |
| Sodium sulfite | 3.5 g |
| Hydroxylamine sulfate | 2.8 g |
| Sodium bromide | 1.3 g |
| Potassium iodide | 0.8 mg |
| Inventive compound or comparative compound | See Table 8 |
| <Bleacher> (in a tablet type for 1 liter use) | |
| Ferric potassium 1,3-propanediamine tetraacetate | 180 g |
| Ferric sodium ethylenediamine tetraacetate | 40 g |
| Sodium ethylenediamine tetraacetate | 5 g |
| Potassium bromide | 150 g |
| Sodium borate | 35 g |
| Maleic acid | 28 g |
| <Fixer> (In a tablet type for 1 liter use) | |
| Sodium thiosulfate | 200 g |
| Sodium sulfite | 20 g |
| Potassium thiocyanate | 100 g |
| Sodium ethylenediamine tetraacetate | 5 g |
| <Stabilizer> (In a slurry type for 1 liter use) | |
| m-hydroxybenzaldehyde | 2 g |
| Hexamethylene tetramine | 1.5 g |
| I-32 (an inventive compound) | 8 g |

The experiments of each of the resulting processing agents were tried in the same manner as in Example 1.

The results are shown in Table 8.

However, the transmission green densities in the unexposed areas were measured with a photoelectric densitometer.

TABLE 8

| Experiment No. | Inventive compound or Comparative compund: Kind | Amount (g/l) | Tablet dissolving rate** (in relative values) | Day numbers to produce tar in storage | Transmission green density in unexposed area | Remarks |
|---|---|---|---|---|---|---|
| 1-1 | — | — | 100 (Criterion) | 7 | 0.58 | Comparison |
| 1-2 | PEG1540*(in solid) | 5 | 85 | 10 | 0.56 | Comparison |
| 1-3 | PEG1540*(in solid) | 10 | 80 | 13 | 0.55 | Comparison |
| 1-4 | PEG1540*(in solid) | 20 | 90 | 15 | 0.55 | Comparison |
| 1-5 | PEG1540*(in solid) | 50 | — | — | — | Comparison (PEG1540, not completely dissolved) |
| 1-6 | Exemplified inventive compound (I-32) | 5 | 75 | 14 | 0.54 | Invention |
| 1-7 | Exemplified | 10 | 65 | 20 | 0.53 | Invention |

TABLE 8-continued

| Experiment No. | Inventive compound or Comparative compund: Kind | Amount (g/l) | Tablet dissolving rate** (in relative values) | Day numbers to produce tar in storage | Magenta reflection density in unexposed area | Remarks |
|---|---|---|---|---|---|---|
| | inventive compound (I-32) | | | | | |
| 1-8 | Exemplified inventive compound (I-32) | 20 | 55 | 30 | 0.52 | Invention |
| 1-9 | Exemplified inventive compound (I-32) | 50 | 50 | 30 | 0.52 | Invention |
| 1-10 | Exemplified inventive compound (I-32) | 70 | 50 | 33 | 0.52 | Invention |
| 1-11 | Exemplified inventive compound (I-32) | 80 | 60 | 33 | 0.53 | Invention |
| 1-12 | Exemplified inventive compound (I-32) | 100 | 65 | 33 | 0.54 | Invention |
| 1-13 | Exemplified inventive compound (I-16) | 50 | 53 | 29 | 0.52 | Invention |
| 1-14 | Exemplified inventive compound (I-17) | 50 | 55 | 30 | 0.52 | Invention |
| 1-15 | Exemplified inventive compound (I-18) | 50 | 50 | 33 | 0.52 | Invention |
| 1-16 | Exemplified inventive compound (I-48) | 50 | 65 | 28 | 0.54 | Invention |
| 1-17 | Exemplified inventive compound (I-49) | 50 | 63 | 29 | 0.53 | Invention |

*PEG1540: Polyethylene diglycol (with a weight average molecular weight of 1540)
**The tablet dissolving rates were indicated by a relative values to that of 1-1 regarded as a value of 100 (as the criterion); It means the smaller a figure is, the shorter a dissolving time is.

It can be proved that a photographic processing agent can be provided so that the solubility thereof could remarkably be improved and the prevention of the tar and stain productions could also be improved.

Example 5

The experiment were carried out in the same way as in Experiment No. 1–9 of Example 1, except that a compound described below was used in an equimolecular amount instead of diethylhydroxyl-amine.oxalic acid.

$HON(CH_2CH_2SO_3Na)_2$

Tablet dissolving rate is 45 and day number to produce tar in storage is 33. The experimental result exhibits the effect of the invention.

What is claimed is:

1. A solid photographic color developing composition in tablet form having a bulk density of 1.0 to 6.0 g/cm$^3$ for a silver halide photographic light-sensitive material, comprising a p-phenylene diamine having a water-solubilizing group selected from the group consisting of $-(CH_2)_nCH_2OH$, $-(CH_2)_m-NH-SO_2(CH_2)_nCH_3$, $-(CH_2)_mO(CH_2)_nCH_3$, $-(CH_2CH_2O)_nC_mH_{2m+1}$, —COOH and $-SO_3H$, wherein m and n each represent an integer of not less than 0; and at least one of the compounds represented by the following Formula (I):

Formula (I)

$R-(O)_nSO_3X$ wherein R represents a phenyl group; X represents a hydrogen atom, an alkali metal or an ammonium group; and n is an integer of 0 or 1.

2. The solid photographic color developing composition of claim 1, wherein said R in Formula (I) represents a phenyl group having an alkyl group with 1 to 4 carbon atoms, a hydroxyl group, an amino group, a nitro group, a carboxyl group or a sulfonic acid group; X represents an alkali metal or an ammonium group; and n is 0.

3. The solid photographic color developing composition of claim 1, further comprising a fluorescent whitening agent represented by the following Formula (E):

Formula (E)

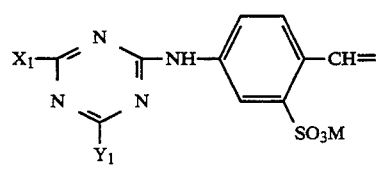

-continued

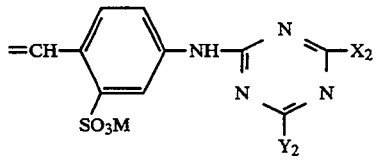

wherein $X_1$, $X_2$, $Y_1$ and $Y_2$ each represent a hydroxyl group, a halogen atom, an alkyl group, an aryl group, a $—N(R_{21})(R_{22})$ group,

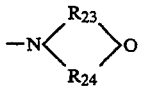

or $—OR_{25}$ in which $R_{21}$ and $R_{22}$ each represent a hydrogen atom, an alkyl group or an aryl group; $R_{23}$ and $R_{24}$ each represent an alkylene group; $R_{25}$ represents a hydrogen atom, an alkyl group or an aryl group; and M represents a cation.

4. The solid photographic color developing composition of claim 1, further comprising a compound selected from the group consisting of those represented by the following Formulas (A), (B) and (A'):

Formula (A)

$R_1R_2N—OH$

Formula (B)

$R_{11}R_{12}N—NR_{13}(R_{15})_nR_{14}$

Formula (A')

$R(A—L—)N—OH$ wherein $R_1$ and $R_2$ each represent a hydrogen atom, an alkyl group, an aryl group, or $R_3C(=O)—$ wherein $R_3$ represents an alkyl group, an alkoxy group or an aryl group; $R_{11}$, $R_{12}$ and $R_{13}$ each represent a hydrogen atom, an alkyl group, an aryl group or a heterocyclic group; $R_{14}$ represents an alkyl group, an alkoxy group, an aryl group, alkoxy group, an aryloxy group, a carbamoyl group, an amino group, a hydroxy group or a hydroxyamino group; $R_{15}$ represents —CO—, $—SO_2$ or —C(=NH), n is 0 or 1, provided that when n is 0, $R_{13}$ and $R_{14}$ may together form a heterocyclic group; R represents a hydrogen atom or an alkyl group; A represents a carboxyl group, a sulfo group, a phosphono group, a phosphino group, a hydroxyl group, an amino group, an amido group, a carbamoyl group or a sulfamoyl group; and L represents a substituted or unsubstituted alkylene group.

5. A solid photographic color developing composition having a bulk density of 1.0 to 6.0 g/cm$^3$ for a silver halide photographic light-sensitive material, comprising: (a) a p-phenylene diamine having a water-solubilizing group selected from the group consisting of $—(CH_2)_nCH_2OH$, $—(CH_2)_m—NHSO_2(CH_2)_nCH_3$, $—(CH_2)_mO(CH_2)_nCH_3$, $—(CH_2CH_2O)_nC_mH_{2m+1}$, —COOH and $—SO_3H$ wherein m and n each represent an integer of not less than 0; (b) a compound selected from the group consisting of those represented by the following Formulas (A), (B) and (A'):

Formula (A)

$R_1R_2N—OH$

Formula (B)

$R_{11}R_{12}N—NR_{13}(R_{15})_nR_{14}$

Formula (A')

$R(A—L—)N—OH$ wherein $R_1$ and $R_2$ each represent a hydrogen atom, an alkyl group, an aryl group, or $R_3C(=O)—$ wherein $R_3$ represents an alkyl group, an alkoxy group or an aryl group; $R_{11}$, $R_{12}$ and $R_{13}$ each represent a hydrogen atom, an alkyl group, an aryl group or a heterocyclic group; $R_{14}$ represents an alkyl group, an alkoxy group, an aryl group, an aryloxy group, a carbamoyl group, an amino group, a hydroxy group or a hydroxyamino group; $R_{15}$ represents —CO—, $—SO_2—$, or —C(=NH)—; n is 0 or 1, provided that when n is 0, $R_{13}$ and $R_{14}$ may form a heterocycle together; R represents a hydrogen atom or an alkyl group; A represents a carboxyl group, a sulfo group, a phosphono group, a phosphino group, a hydroxyl group, an amino group, an amido group, a carbamoyl group or a sulfamoyl group; and L represents a substituted or unsubstituted alkylene group; (c) a fluorescent whitening agent represented by the following Formula (E):

Formula (E)

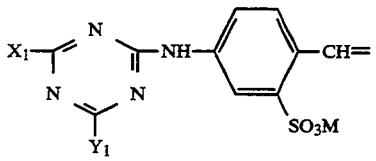

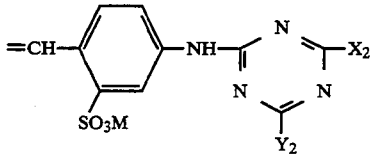

wherein $X_1$, $X_2$, $Y_1$ and $Y_2$ each represent a hydroxyl group, a halogen atom, an alkyl group, an aryl group, a $—N(R_{21})(R_{22})$ group,

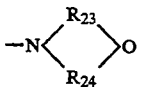

or $—OR_{25}$ in which $R_{21}$ and $R_{22}$ each represent a hydrogen atom, an alkyl group or an aryl group; $R_{23}$ and $R_{24}$ each represent an alkylene group; $R_{25}$ represents a hydrogen atom, an alkyl group or an aryl group; and M represents a cation; and (d) at least one of the compounds represented by the following Formula (I):

Formula (I)

$R—(O)_nSO_3X$ wherein R represents a phenyl group; X represents a hydrogen atom, an alkali metal or an ammonium group; and n is an integer of 0 or 1.

* * * * *